US009244431B2

(12) United States Patent
Kikushima et al.

(10) Patent No.: US 9,244,431 B2
(45) Date of Patent: Jan. 26, 2016

(54) FIXING DEVICE AND IMAGE FORMING APPARATUS

(71) Applicants: Yuuki Kikushima, Kanagawa (JP); Masami Okamoto, Kanagawa (JP); Keisuke Kubota, Kanagawa (JP); Kenji Nozawa, Kanagawa (JP); Yoshikuni Sasaki, Kanagawa (JP); Fumihiro Hirose, Kanagawa (JP); Kensuke Yamaji, Kanagawa (JP); Shuutaroh Yuasa, Kanagawa (JP); Kaori Hemmi, Kanagawa (JP)

(72) Inventors: Yuuki Kikushima, Kanagawa (JP); Masami Okamoto, Kanagawa (JP); Keisuke Kubota, Kanagawa (JP); Kenji Nozawa, Kanagawa (JP); Yoshikuni Sasaki, Kanagawa (JP); Fumihiro Hirose, Kanagawa (JP); Kensuke Yamaji, Kanagawa (JP); Shuutaroh Yuasa, Kanagawa (JP); Kaori Hemmi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/645,202

(22) Filed: Mar. 11, 2015

(65) Prior Publication Data

US 2015/0261183 A1 Sep. 17, 2015

(30) Foreign Application Priority Data

| | | |
|---|---|---|
| Mar. 12, 2014 | (JP) | 2014-048588 |
| May 26, 2014 | (JP) | 2014-108106 |
| Aug. 22, 2014 | (JP) | 2014-169318 |

(51) Int. Cl.
*G03G 15/20* (2006.01)
*G03G 21/20* (2006.01)

(52) U.S. Cl.
CPC ..... *G03G 21/206* (2013.01); *G03G 15/2039* (2013.01)

(58) Field of Classification Search
CPC ..... G03G 21/206; G03G 15/2039
USPC ..... 399/69
See application file for complete search history.

(56) References Cited

U.S. PATENT DOCUMENTS

| | | | |
|---|---|---|---|
| 2011/0222890 | A1 | 9/2011 | Kikushima et al. |
| 2012/0224869 | A1 | 9/2012 | Yamada |
| 2012/0269532 | A1 | 10/2012 | Watanabe |
| 2014/0112680 | A1 | 4/2014 | Ueno et al. |
| 2014/0199090 | A1 | 7/2014 | Kikushima |

FOREIGN PATENT DOCUMENTS

| | | |
|---|---|---|
| JP | 10-048981 | 2/1998 |
| JP | 2004-151471 | 5/2004 |
| JP | 2006-139180 | 6/2006 |
| JP | 2006-293240 | 10/2006 |
| JP | 2007-328161 | 12/2007 |
| JP | 2008-165091 | 7/2008 |
| JP | 2009-025405 | 2/2009 |
| JP | 2009-210792 | 9/2009 |
| JP | 2009-237203 | 10/2009 |
| JP | 2010-164860 | 7/2010 |

(Continued)

*Primary Examiner* — David Bolduc
*Assistant Examiner* — Barnabas Fekete
(74) *Attorney, Agent, or Firm* — Harness, Dickey & Pierce, P.L.C.

(57) ABSTRACT

A fixing device includes an elastic rotator and a cooler disposed opposite the rotator to cool the rotator with cooling air. A mover contacts and moves the rotator to a first position where the rotator is disposed opposite the cooler with an increased first interval therebetween and a second position where the rotator is disposed opposite the cooler with a decreased second interval therebetween. A rectification plate is movably mounted on the cooler to contact the rotator constantly to guide the cooling air to the cooler.

20 Claims, 11 Drawing Sheets

(56) References Cited

FOREIGN PATENT DOCUMENTS

| | | |
|---|---|---|
| JP | 2011-123373 | 6/2011 |
| JP | 2011-215581 | 10/2011 |
| JP | 2012-185276 | 9/2012 |
| JP | 2012-226269 | 11/2012 |
| JP | 2014-032374 | 2/2014 |
| JP | 2014-102486 | 6/2014 |
| JP | 2014-137487 | 7/2014 |
| JP | 2014-178509 | 9/2014 |
| JP | 2014-224886 | 12/2014 |

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2014-048588, filed on Mar. 12, 2014, 2014-108106, filed on May 26, 2014, and 2014-169318, filed on Aug. 22, 2014, in the Japanese Patent Office, the entire disclosure of each of which is hereby incorporated by reference herein.

BACKGROUND

1. Technical Field

Example embodiments generally relate to a fixing device and an image forming apparatus, and more particularly, to a fixing device for fixing a toner image on a recording medium and an image forming apparatus incorporating the fixing device.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing roller, an endless fixing belt rotated by the fixing roller and heated by a heater, and a pressure roller pressed against the fixing roller via the fixing belt to form a fixing nip between the fixing belt and the pressure roller. As a recording medium bearing a toner image is conveyed through the fixing nip, the fixing belt and the pressure roller apply heat and pressure to the recording medium, melting and fixing the toner image on the recording medium.

SUMMARY

At least one embodiment provides a novel fixing device that includes an elastic rotator and a cooler disposed opposite the rotator to cool the rotator with cooling air. A mover contacts and moves the rotator to a first position where the rotator is disposed opposite the cooler with an increased first interval therebetween and a second position where the rotator is disposed opposite the cooler with a decreased second interval therebetween. A rectification plate is movably mounted on the cooler to contact the rotator constantly to guide the cooling air to the cooler.

At least one embodiment provides a novel image forming apparatus that includes an image forming device to form a toner image and a fixing device, disposed downstream from the image forming device in a recording medium conveyance direction, to fix the toner image on a recording medium. The fixing device includes an elastic rotator and a cooler disposed opposite the rotator to cool the rotator with cooling air. A mover contacts and moves the rotator to a first position where the rotator is disposed opposite the cooler with an increased first interval therebetween and a second position where the rotator is disposed opposite the cooler with a decreased second interval therebetween. A rectification plate is movably mounted on the cooler to contact the rotator constantly to guide the cooling air to the cooler.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
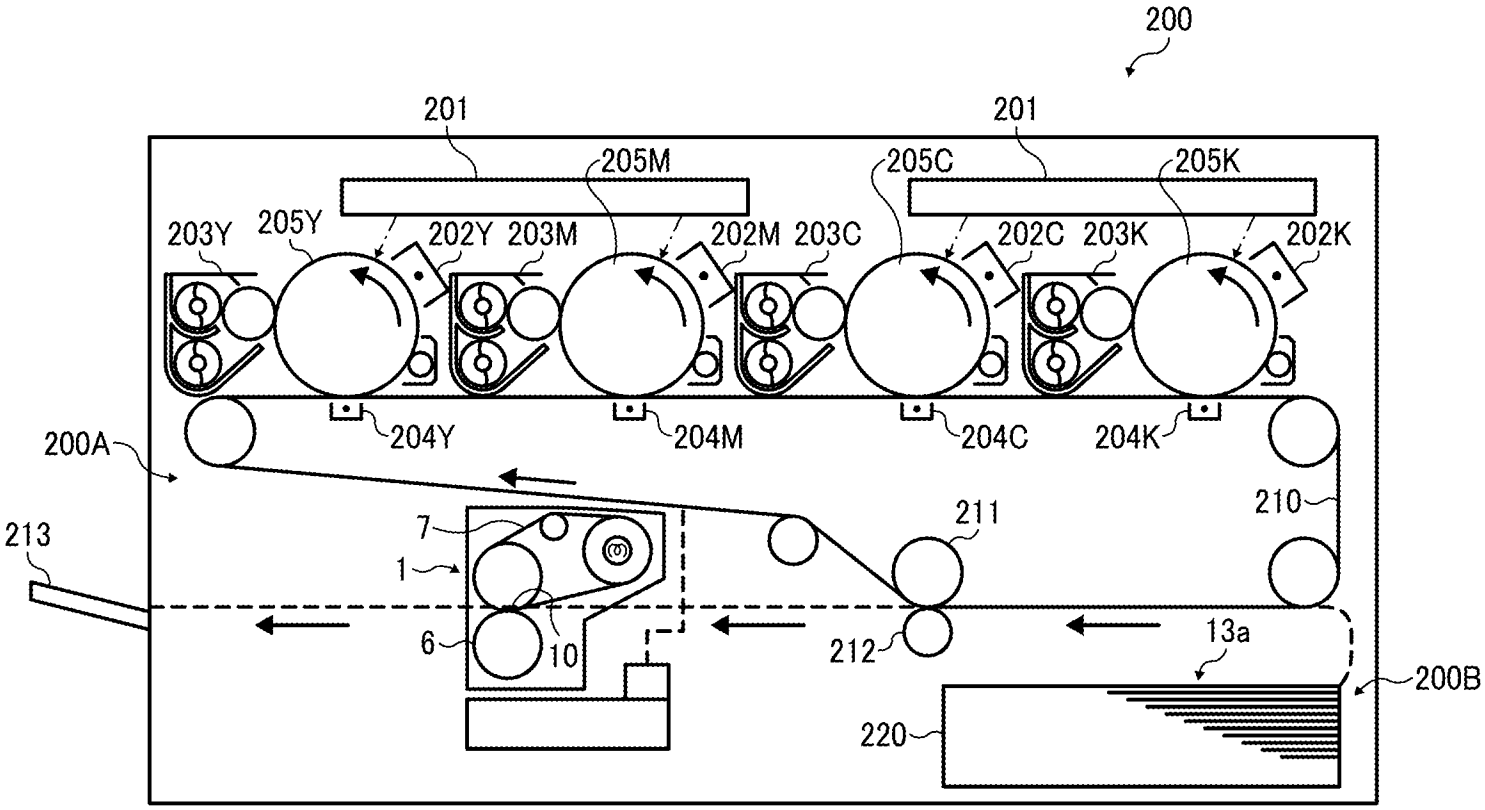
FIG. 1 is a schematic vertical sectional view of an image forming apparatus according to an example embodiment of the present disclosure.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein are interpreted accordingly.

Although the terms first, second, and the like may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to be limiting of the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 200 according to an example embodiment is explained.

FIG. 1 is a schematic vertical sectional view of the image forming apparatus 200. The image forming apparatus 200 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 200 is a color copier that forms color and monochrome toner images on recording media by electrophotography. Alternatively, the image forming apparatus 200 may be a monochrome copier that forms monochrome toner images.

A description is provided of a construction of the image forming apparatus 200.

As shown in FIG. 1, the image forming apparatus 200 is a high speed, tandem color copier.

The image forming apparatus 200 includes an image forming device 200A situated in a center portion of the image forming apparatus 200, a sheet feeder 200B situated below the image forming device 200A, and an image reader situated above the image forming device 200A.

A detailed description is now given of a construction of the image forming device 200A.

The image forming device 200A includes a fixing device 1 and a transfer belt 210 having a horizontally extending, transfer face.

An upper face of the transfer belt 210 is disposed opposite components that form toner images in complementary colors created based on separation colors. For example, photoconductors 205Y, 205M, 205C, and 205K, serving as image bearers that bear yellow, magenta, cyan, and black toner images in the complementary colors, respectively, are aligned along the transfer face of the transfer belt 210.

Each of the photoconductors 205Y, 205M, 205C, and 205K is a drum rotatable counterclockwise in FIG. 1 in an identical direction. The photoconductors 205Y, 205M, 205C, and 205K are surrounded by an optical writing device 201, chargers 202Y, 202M, 202C, and 202K, developing devices 203Y, 203M, 203C, and 203K, primary transfer devices 204Y, 204M, 204C, and 204K, and cleaners, respectively, which perform image formation processes as the photoconductors 205Y, 205M, 205C, and 205K rotate.

The developing devices 203Y, 203M, 203C, and 203K contain yellow, magenta, cyan, and black toners, respectively. The transfer belt 210 looped over a driving roller and a plurality of driven rollers is disposed opposite the photoconductors 205Y, 205M, 205C, and 205K and rotatable clockwise in FIG. 1. A roller 211, that is, one of the plurality of driven rollers, is disposed opposite a transfer roller 212 via the transfer belt 210. A conveyance path extends horizontally from the transfer roller 212 to the fixing device 1 to convey a sheet 13*a*.

A detailed description is now given of a construction of the sheet feeder 200B.

The sheet feeder 200B includes a paper tray 220 that loads a plurality of sheets 13*a* serving as recording media and a feed device that separates an uppermost sheet 13*a* from other sheets 13*a* loaded in the paper tray 220 and conveys the sheet 13*a* to the transfer roller 212.

A description is provided of a print job performed by the image forming apparatus 200 having the construction described above.

The charger 202Y uniformly changes an outer circumferential surface of the photoconductor 205Y. The optical writing device 201 forms an electrostatic latent image on the photoconductor 205Y according to image data sent from the image reader. The developing device 203Y containing yellow toner visualizes the electrostatic latent image into a yellow toner image. The primary transfer device 204Y applied with a given bias primarily transfers the yellow toner image onto the transfer belt 210.

Similarly, magenta, cyan, and black toner images are formed on the photoconductors 205M, 205C, and 205K, respectively, and primarily transferred onto the transfer belt 210 successively by an electrostatic force such that the yellow, magenta, cyan, and black toner images are superimposed on a same position on the transfer belt 210, thus forming a color toner image on the transfer belt 210.

The roller 211 and the transfer roller 212 secondarily transfer the color toner image formed on the transfer belt 210 onto the sheet 13*a* conveyed from the paper tray 220. The sheet 13*a* bearing the color toner image is conveyed further to the fixing device 1 where the color toner image is fixed on the sheet 13*a* as the sheet 13*a* passes through a fixing nip 10 formed between a fixing belt 7 and a pressure roller 6. The sheet 13*a* ejected from the fixing nip 10 is conveyed onto a stacker 213 through an output path.

Figure 2:
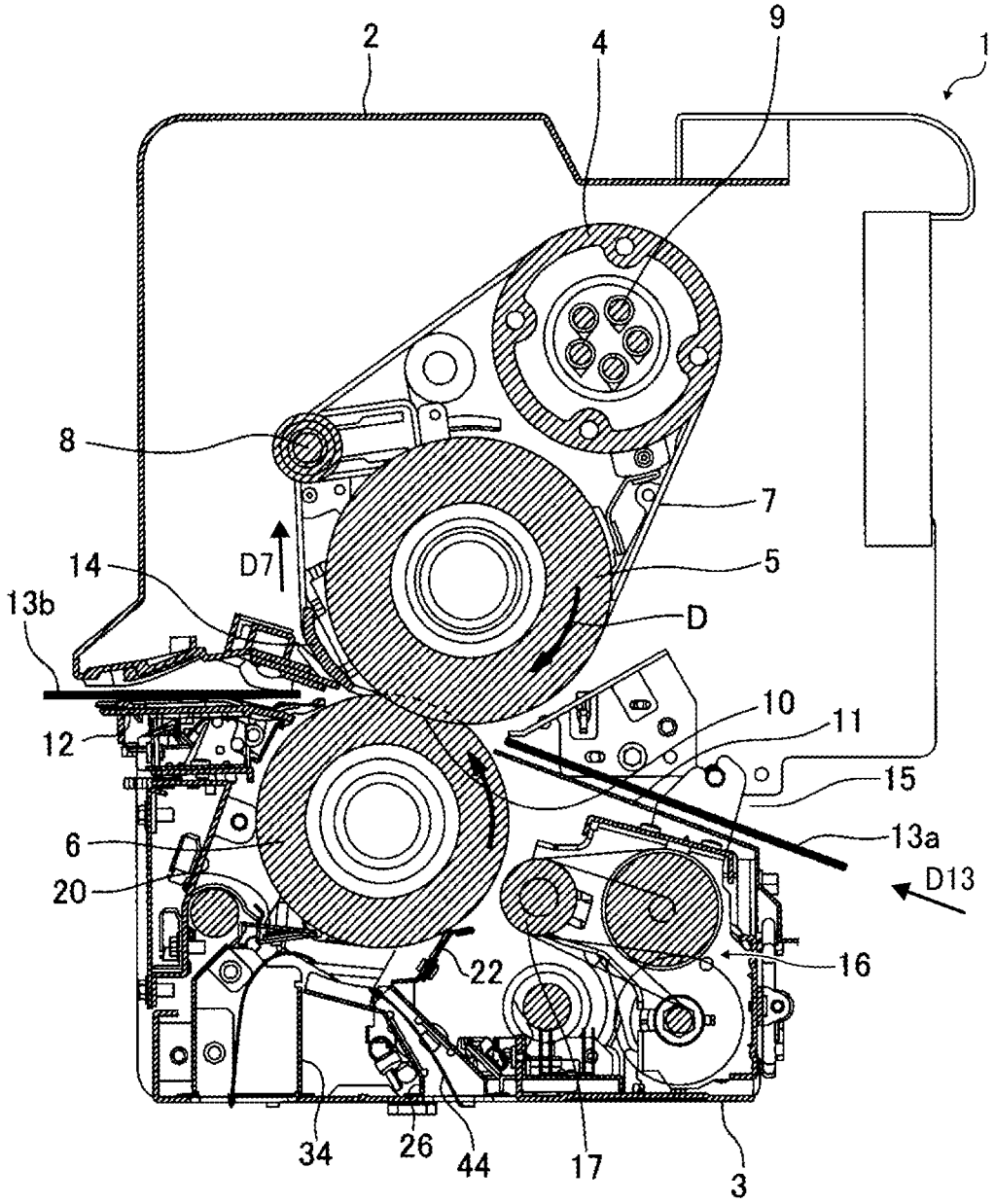
FIG. 2 is a vertical sectional view of a fixing device incorporated in the image forming apparatus shown in FIG. 1.
Figure 3:
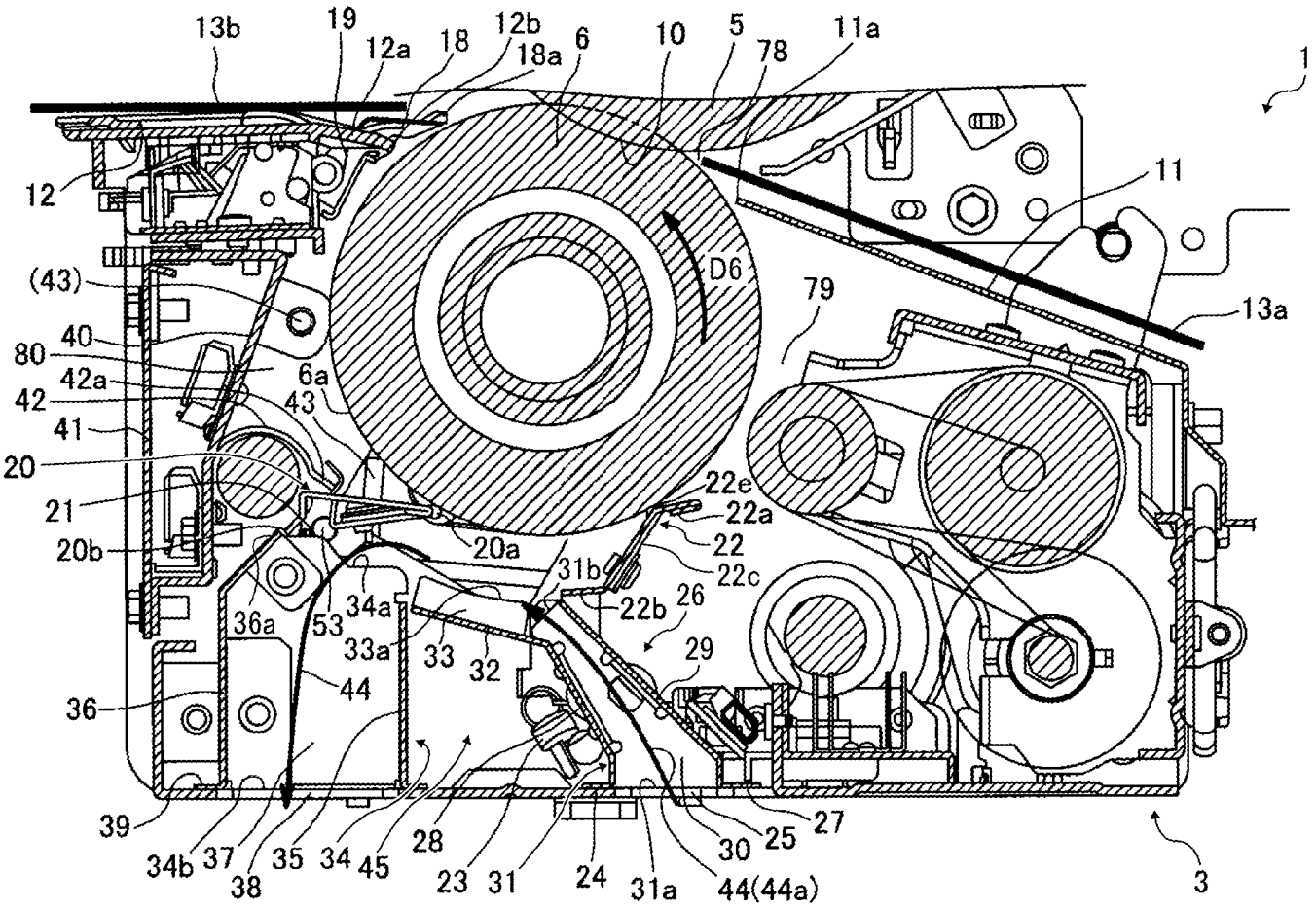
FIG. 3 is a partial vertical sectional view of the fixing device shown in FIG. 2.

With reference to FIGS. 2 and 3, a description is provided of a construction of the fixing device 1 incorporated in the image forming apparatus 200 described above.

FIG. 2 is a vertical sectional view of the fixing device 1. As shown in FIG. 2, the fixing device 1 (e.g., a fuser or a fusing unit) includes an upper cover 2 and a lower cover 3 accommodating a heating roller 4, a fixing roller 5 rotatable clockwise in FIG. 2 in a rotation direction D, and the pressure roller 6 serving as a rotator, a pressure rotator, or a pressure member rotatable counterclockwise in FIG. 2, which are aligned in this order obliquely left downward. The heating roller 4 and the fixing roller 5 are isolated from each other radially with a slight interval therebetween. The fixing belt 7 is looped over the heating roller 4 and the fixing roller 5. A tension roller 8 having a decreased diameter biases the fixing belt 7 leftward. It is to be noted that directions defined by upward, downward, leftward, rightward, frontward, rearward, vertically, horizontally, obliquely, and the like are used with reference to the drawings and therefore do not limit the location and the construction of the fixing device 1.

The heating roller 4 accommodates a plurality of heaters 9. An upper outer circumferential surface of the pressure roller 6 is pressed against a lower outer circumferential surface of the fixing roller 5 elastically. For example, the pressure roller 6 is pressed against the fixing roller 5 via the fixing belt 7. A detailed description of a configuration of the fixing belt 7 is omitted. Alternatively, the fixing device 1 may have a construction that does not incorporate the fixing belt 7. The pressure roller 6 includes an elastic layer constituting the outer circumferential surface of the pressure roller 6.

An upstream, entry sheet guide plate 11, that is, a right sheet guide plate in FIG. 2 disposed upstream from the fixing nip 10 in a sheet conveyance direction D13, is angled left upward and directed to the fixing nip 10. Conversely, a downstream, exit sheet guide plate 12, that is, a left sheet guide plate in FIG. 2 disposed downstream from the fixing nip 10 in the sheet conveyance direction D13 and in proximity to an exit of the fixing nip 10, extends substantially horizontally. Sheets 13*a* and 13*b* serving as recording media are conveyed over an upper face of each of the entry sheet guide plate 11 and the exit sheet guide plate 12. The sheets 13*a* and 13*b* are one example of recording media conveyed through the fixing device 1.

A fixing belt guide plate 14 is disposed downstream from the fixing nip 10 in the sheet conveyance direction D13 on the left of the fixing nip 10 in FIG. 2. The fixing belt guide plate 14 is angled obliquely upward and directed to the tension roller 8. The fixing belt 7 rotates along the fixing belt guide plate 14 in a rotation direction D7 from the fixing nip 10 to the tension roller 8. The fixing belt 7 and the heating roller 4 and the fixing roller 5 situated inside a loop formed by the fixing belt 7 are housed by the upper cover 2. The pressure roller 6 is housed by the lower cover 3. A sheet conveyance path 15 is produced between the upper cover 2 and the lower cover 3.

FIG. 3 is a partial vertical sectional view of the fixing device 1. As shown in FIG. 3, a left, leading edge 11*a* of the right, entry sheet guide plate 11 is in proximity to the outer circumferential surface of a right upper part of the pressure roller 6. The right, entry sheet guide plate 11 constitutes a part, that is, an upper wall, of the lower cover 3. As shown in FIG. 2, multiple rollers 16 that constitute a cleaning web unit, for example, are located in a space below the right, entry sheet guide plate 11. The multiple rollers 16 include a roller 17 having a decreased diameter that is in proximity to the outer circumferential surface of a right part of the pressure roller 6. A detailed description of a configuration of the multiple rollers 16 is omitted.

As shown in FIG. 3, a right, leading end of the left, exit sheet guide plate 12 is bent obliquely downward to produce a bent portion 12*a*. A right, leading edge 12*b* of the exit sheet guide plate 12 is in proximity to the pressure roller 6. The left, exit sheet guide plate 12 is mounted on the lower cover 3. Above the right, leading edge 12*b* of the left, exit sheet guide plate 12 is a contact plate 18. A right, leading edge 18*a* of the contact plate 18 is in contact with or in proximity to the outer circumferential surface of the pressure roller 6. A spring 19 serving as a biasing member biases the right, leading edge 18*a* of the contact plate 18 downward constantly.

Below the left, exit sheet guide plate 12 is a rectification plate 20 serving as a left rectification plate or a first rectification plate. The rectification plate 20 is slightly tilted right downward and is substantially parallel to a tangential direction to the pressure roller 6. A right, leading edge 20*a* of the rectification plate 20 contacts the outer circumferential surface of a lower left part of the pressure roller 6. The right, leading edge 20*a* of the rectification plate 20 may mount an abutment (e.g., a rotary body) described below. The rectification plate 20 has a length in an axial direction of the pressure roller 6 that is equivalent to a length of the pressure roller 6 in the axial direction thereof. Accordingly, the rectification plate 20 guides cooling air 44 to an outlet 38 smoothly without adversely affecting rotation of the pressure roller 6.

A spring 21 serving as a biasing member contacting a lower left part of the rectification plate 20 biases the rectification plate 20 constantly to rotate a right end of the rectification plate 20 counterclockwise upward. Accordingly, even when the pressure roller 6 is moved downward and isolated from the fixing belt 7 while the sheet 13*a* is not conveyed through the fixing nip 10, the leading edge 20*a* of the rectification plate 20 constantly contacts the outer circumferential surface of the pressure roller 6. The rectification plate 20 is also called a current plate. A detailed description of examples of the rectification plate 20 is deferred.

On the right of the rectification plate 20 and a lower end of the pressure roller 6 is another rectification plate 22 serving as a right rectification plate or a second rectification plate angled right upward. The right rectification plate 22 includes a sloped wall 22*c*, a head wall 22*a*, and a base wall 22*b*. The sloped wall 22*c* is angled right upward. The head wall 22*a*, that is, an upper end wall, is contiguous to an upper edge or a leading edge of the sloped wall 22*c* and bent rightward. The head wall 22*a* is tilted right upward substantially horizontally.

The base wall 22*b*, that is, a lower end wall, is contiguous to a lower edge or a base edge of the sloped wall 22*c* and bent leftward. The base wall 22*b* extends substantially horizontally. Thus, the sloped wall 22*c*, the head wall 22*a*, and the base wall 22*b* constitute a rectification body, that is, the rectification plate 22.

For example, each of front and rear ends of the base wall 22*b* is contiguous to a support plate disposed below and perpendicular to the base wall 22*b* and spanning horizontally. The support plate is supported by a horizontal hinge shaft such that the support plate, together with the rectification plate 22, is rotatable vertically. A spring 23 (e.g., a tension coil spring and a torsion coil spring) serving as a biasing member biases a lower left part of the support plate downward.

Below the head wall 22*a* of the right rectification plate 22 is an inlet 25 to take in air. The inlet 25 penetrates through a bottom wall 24 of the lower cover 3. A cooling duct 26 extends from the inlet 25 obliquely left upward toward the lower end of the pressure roller 6. The cooling duct 26 is mounted on the bottom wall 24 of the lower cover 3 with a lower flange 27.

The cooling duct 26 is constructed of a tube 31, a projection wall 32, and a side wall 33. The tube 31 produces a rectangle constructed of four quarters, that is, a left wall 28, a right wall 29, and front and rear walls 30. The projection wall 32 is contiguous to an upper end of the left wall 28 of the tube 31 and tilted slightly left upward relative to a horizontal line. The side wall 33 projects from each of a front edge and a rear edge of the projection wall 32 toward the pressure roller 6 to create an opening 33*a* disposed opposite the pressure roller 6. An upper end of the tube 31 is open to create an outlet 31*b*, that is, an upper opening, in communication with a space above the projection wall 32. An inlet 31*a* disposed at a lower end of the tube 31 is in communication with the inlet 25 penetrating through the bottom wall 24.

The base wall 22*b* of the right rectification plate 22 is in proximity to an upper end of the right wall 29 of the tube 31 with almost no interval therebetween. As the pressure roller 6 is lowered to release pressure between the fixing belt 7 and the pressure roller 6, the right rectification plate 22 pivots about a hinge shaft serving as a fulcrum clockwise in FIG. 3 downward. Simultaneously, the left rectification plate 20 pivots about a left hinge shaft 53 clockwise in FIG. 3 downward. Accordingly, a left interval and a right interval between an outer circumferential surface 6*a* of the lower end of the pressure roller 6 and a cooler 45 is decreased constantly.

An exhaust duct 34 is on the left of the cooling duct 26. The exhaust duct 34 is constructed of a right wall 35, a left wall 36, and front and rear walls 37. The right wall 35 extends vertically and is in proximity to a left end, that is, a top end, of the projection wall 32 of the cooling duct 26 with almost no interval therebetween. The left wall 36 extends vertically and is disposed opposite the right wall 35. The front and rear walls 37 extend vertically and couple the right wall 35 with the left wall 36. An upper end of the exhaust duct 34 is open to create an inlet 34*a*.

A lower end of the exhaust duct 34 is open to create an outlet 34*b* in communication with the outlet 38 penetrating through the bottom wall 24 of the lower cover 3. A lower flange 39 of the exhaust duct 34 is mounted on the bottom wall 24 of the lower cover 3. The inlet 34*a* situated at the upper end of the exhaust duct 34 is in communication with a space below the pressure roller 6. An upper end of the left wall 36 of the exhaust duct 34 is tilted right upward to produce a slope having an upper edge 36*a* in proximity to a left base end 20*b* of the left rectification plate 20 with almost no interval therebetween.

On the left of the left rectification plate 20 is a wall 40 extending vertically and being tilted right upward along an inner face of a left wall 41 of the lower cover 3. The wall 40 is between the left wall 36 of the exhaust duct 34 and a lower end of the contact plate 18 situated above the wall 40. Above the left rectification plate 20 is a curved wall 42 interposed between the vertical wall 40 and an upper face of the left rectification plate 20. The wall 42 includes a slope 42*a* at a head, that is, a right end, of the wall 42. A leading edge of the slope 42*a* is in proximity to the upper face of a base, that is, a left end, of the left rectification plate 20. As the left rectification plate 20 pivots downward, the wall 42 situated above the rectification plate 20 reduces leakage of cooling air from the base of the rectification plate 20. The base end 20*b*, that is, the left end, of the left rectification plate 20 is constantly in proximity to the upper edge 36*a* of the slope of the left wall 36 of the exhaust duct 34.

For example, the lower cover 3 accommodates a temperature sensor 43 serving as a temperature detector that detects the temperature of the pressure roller 6. The temperature sensor 43 projects upward from the upper face of the left rectification plate 20. The temperature sensor 43 detects the temperature of the outer circumferential surface 6*a* of the pressure roller 6 without contacting the pressure roller 6. For example, the temperature sensor 43 is coupled with the left rectification plate 20. As the pressure roller 6 is lowered to release pressure between the fixing belt 7 and the pressure roller 6, the outer circumferential surface 6*a* of the pressure roller 6 presses against and lowers the rectification plate 20 to pivot the rectification plate 20 about the hinge shaft 53. Simultaneously, the temperature sensor 43 moves downward together with the rectification plate 20. Conversely, as the pressure roller 6 is pressed against the fixing belt 7, the spring 21 moves the temperature sensor 43 upward together with the rectification plate 20. Alternatively, instead of the temperature sensor 43, a temperature sensor may be situated at a position (43) on the vertical wall 40 that is substantially leveled with a shaft of the pressure roller 6. In this case, the temperature sensor situated at the position (43) is stationary.

Figure 4:
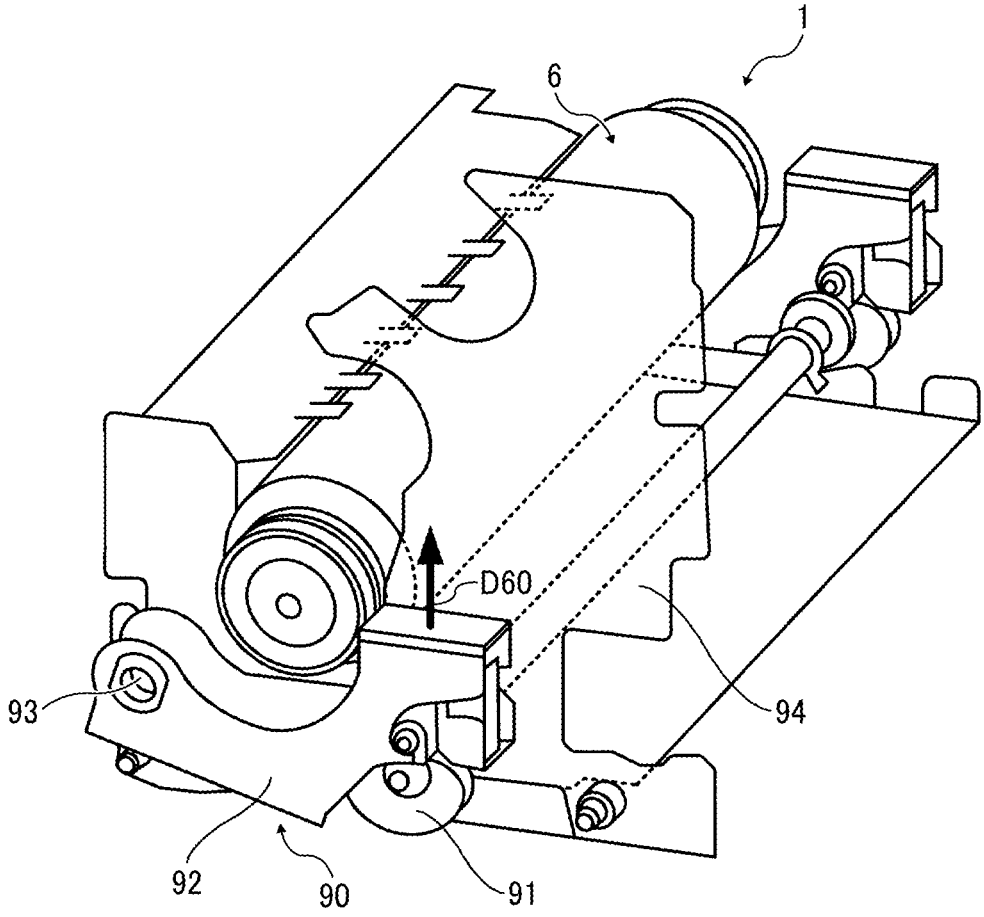
FIG. 4 is a partial perspective view of the fixing device shown in FIG. 3 illustrating a mover incorporated therein.

With reference to FIG. 4, a description is provided of a mover 90 that moves the pressure roller 6.

FIG. 4 is a partial perspective view of the fixing device 1 illustrating the mover 90. As shown in FIG. 4, the mover 90 (e.g., a biasing member) biases the pressure roller 6 obliquely upward against the fixing roller 5 to form the fixing nip 10 between the pressure roller 6 and the fixing belt 7, thus moving the pressure roller 6 radially from an isolation position where the pressure roller 6 is isolated from the fixing belt 7 to a fixing position shown in FIG. 2 where the pressure roller 6 contacts the fixing belt 7 to fix a toner image on a sheet 13*a*.

The mover 90 may include a cam and a spring, a plunger, or the like that move the pressure roller 6 vertically to press the pressure roller 6 against the fixing roller 5 upward and release pressure between the fixing belt 7 and the pressure roller 6. For example, as shown in FIG. 4, the mover 90 includes a cam 91, a shaft 93, and an arm 92 that are disposed at each lateral end of the pressure roller 6 in the axial direction thereof. As the cam 91 rotates, the arm 92 pivots about the shaft 93. As the arm 92 in contact with the pressure roller 6 lifts the pressure roller 6, the pressure roller 6 moves in a direction D60 along a side plate 94. The mover 90 moves the pressure roller 6 radially from the fixing position where the pressure roller 6 contacts the fixing belt 7 to the isolation position where the pressure roller 6 is isolated from the fixing belt 7 and from the isolation position to the fixing position.

Figure 5:
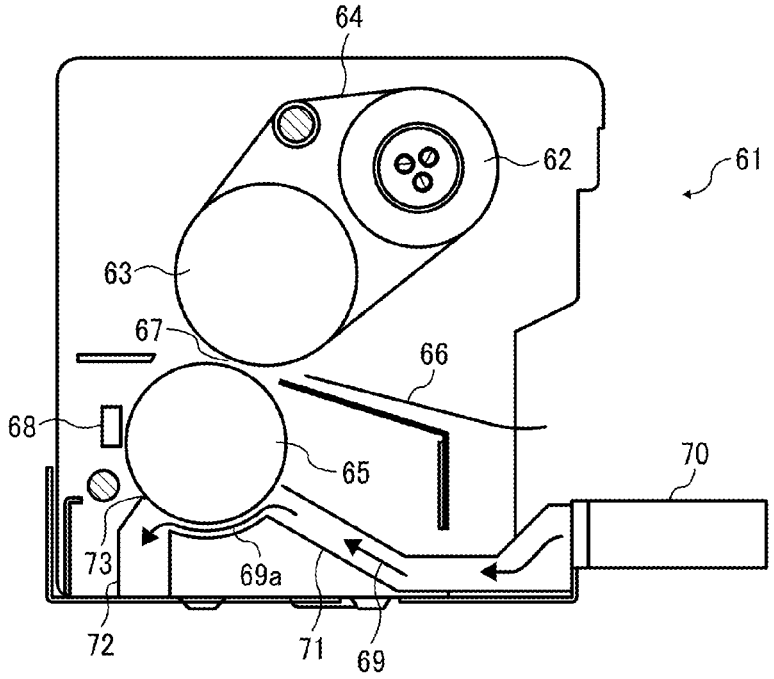
FIG. 5 is a schematic vertical sectional view of a comparative fixing device in a state in which a pressure roller is isolated from a fixing belt during off-printing.
Figure 6:
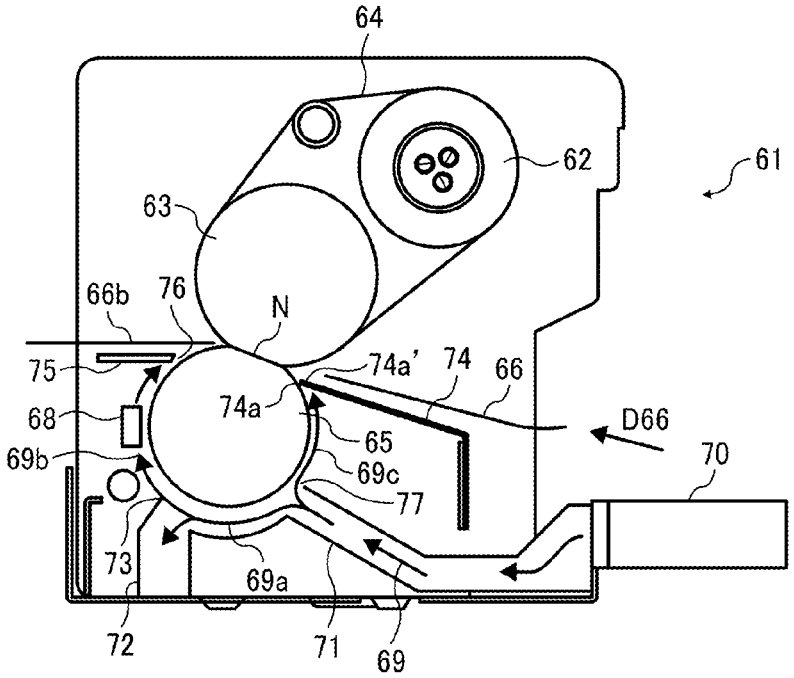
FIG. 6 is a schematic vertical sectional view of the comparative fixing device shown in FIG. 5 in a state in which the pressure roller is pressed against the fixing belt during printing.

With reference to FIGS. 5 and 6, a description is provided of a construction of a comparative fixing device 61.

The comparative fixing device 61 includes a pressure roller 65 incorporating an elastic layer having an increased thickness to reduce creasing and skew of a sheet 66 serving as a recording medium even if the comparative fixing device 61 fixes a toner image on an envelope made of two layered sheets that serves as a recording medium. FIG. 5 is a schematic vertical sectional view of the comparative fixing device 61 in a state in which the pressure roller 65 is isolated from a fixing belt 64 during off-printing. FIG. 6 is a schematic vertical sectional view of the comparative fixing device 61 in a state in which the pressure roller 65 is pressed against the fixing belt 64 during printing.

As shown in FIG. 5, the fixing belt 64 is supported by a heating roller 62 and a fixing roller 63. The heating roller 62 heats the fixing belt 64. As shown in FIG. 6, the pressure roller 65 is pressed against the heated fixing belt 64. As the sheet 66 bearing a toner image is conveyed through a fixing nip N formed between the fixing belt 64 and the pressure roller 65, the fixing belt 64 and the pressure roller 65 fix the toner image on the sheet 66 under heat and pressure.

As shown in FIG. 5, in order to extend the life of the fixing belt 64 and the pressure roller 65, the pressure roller 65 separates from the fixing belt 64 to an isolation position, that is, a retracted position, where the pressure roller 65 is isolated from the fixing belt 64 with an interval 67 therebetween. A temperature sensor 68 is disposed opposite the pressure roller 65 to detect the temperature of the pressure roller 65. The temperature sensor 68 is used to adjust an amount of cooling air 69 that cools the pressure roller 65.

A cooling duct 71 guides the cooling air 69 blown out of a cooling blower 70 to the pressure roller 65 to cause the cooling air 69 to blow against the pressure roller 65. A guided cooling air 69*a* cools an outer circumferential surface of the pressure roller 65 and is exhausted to an outside of the fixing device 61 through an exhaust duct 72. While the pressure roller 65 is isolated from the fixing belt 64, an interval 73 is not produced between the pressure roller 65 and the exhaust duct 72. Accordingly, the guided cooling air 69*a* is exhausted to the outside of the fixing device 61 through the exhaust duct 72.

As shown in FIG. 6, when the pressure roller 65 is pressed against the fixing belt 64 during printing, the pressure roller 65 moves from the isolation position shown in FIG. 5 toward the fixing roller 63, thus pressing against the fixing roller 63 via the fixing belt 64. As the sheet 66 bearing the unfixed toner image guided by an upstream, entry guide plate 74 is conveyed through the fixing nip N formed between the fixing belt 64 and the pressure roller 65, the fixing belt 64 and the pressure roller 65 heat and fix the toner image on the sheet 66. Thereafter, a sheet 66*b* bearing the fixed toner image is ejected from the fixing nip N as it is guided by a downstream, exit guide plate 75.

However, while the pressure roller 65 is moved and pressed against the fixing roller 63 via the fixing belt 64 during printing, the interval 73 corresponding to a movement distance of the pressure roller 65 is produced between the exhaust duct 72 and the pressure roller 65. Simultaneously, an interval 77 corresponding to the movement distance of the pressure roller 65 is produced between the cooling duct 71 and the pressure roller 65. Accordingly, cooling air 69*b* traveling through the interval 73 and cooling air 69*c* traveling through the interval 77 may change the temperature of a space inside the fixing device 61, degrading accuracy in detecting the temperature of the pressure roller 65 by the temperature sensor 68 and accuracy in adjusting the amount of the cooling air 69 based on a detection signal from the temperature sensor 68.

Additionally, while the cooling air 69*a* cools the pressure roller 65 during printing, the cooling air 69*b* leaking through the interval 73 corresponding to the movement distance of the pressure roller 65 further travels along the pressure roller 65 through an interval 76 between the exit guide plate 75 and the pressure roller 65, blowing against the sheet 66*b* bearing the fixed toner image. Further, when a leading edge of the entry guide plate 74 is situated at a position 74*a*', an interval 74*a* is produced between the leading edge of the entry guide plate 74 and the pressure roller 65. The cooling air 69*c* leaking through the interval 74*a* travels along the pressure roller 65 and blows against the sheet 66 upstream from the fixing nip N in a sheet conveyance direction D66. Accordingly, motion of the sheets 66 and 66*b* are destabilized, causing jamming of the sheets 66 and 66*b*.

A description is provided of advantages of the fixing device 1 having the construction described above with reference to FIGS. 2 and 3.

As shown in FIG. 3, the left rectification plate 20 that moves in accordance with movement of the pressure roller 6 is disposed opposite the exhaust duct 34. The left rectification plate 20 covers an interval or an opening between the outer circumferential surface 6*a* of the pressure roller 6 and the upper edge 36*a* of the slope of the left wall 36 of the exhaust duct 34. Accordingly, during printing when the pressure roller 6 is pressed against the fixing belt 7 and during off-printing when the pressure roller 6 is isolated from the fixing belt 7 or pressure between the fixing belt 7 and the pressure roller 6 is released, the left interval produced between the exhaust duct 34 and the pressure roller 6 is decreased. Additionally, the cooling air 44 travels along the outer circumferential surface 6*a* of the pressure roller 6 in a direction indicated by the arrows in FIG. 3 effectively, thus cooling the pressure roller 6 efficiently. The cooling air 44 travels from the upper outlet 31*b* of the cooling duct 26 along the lower outer circumferential surface 6*a* of the pressure roller 6 and a lower face of the rectification plate 20 effectively, being exhausted to an outside of the fixing device 1 through the exhaust duct 34. A blower sends cooling air 44*a* to the cooling duct 26.

The left rectification plate 20 prevents the cooling air 44 from leaking from the exhaust duct 34 to a space on the upper left of the rectification plate 20. Accordingly, the cooling air 44 does not travel through an interval between the exit sheet guide plate 12 and the pressure roller 6 and does not blow against the sheet 13*b* bearing the fixed toner image, preventing the sheet 13*b* from being jammed. Additionally, since the cooling air 44 does not blow against the temperature sensor 43 that detects the temperature of the pressure roller 6, the cooling air 44 does not change the temperature of the temperature sensor 43, retaining detection accuracy of the temperature sensor 43.

During off-printing as well as during printing, that is, before and after the pressure roller 6 moves radially to form the fixing nip 10, the cooling air 44 moves along the pressure roller 6 and the rectification plate 20 effectively and is exhausted to the outside of the fixing device 1 through the exhaust duct 34.

The cooling air 44 blown out from the cooling duct 26 is directed to the left rectification plate 20. That is, the left rectification plate 20 is on the left of the outer circumferential surface 6*a* of the lower end of the pressure roller 6. The outlet 31*b*, that is, an upper opening, of the cooling duct 26 is on the right of the rectification plate 20 and situated substantially immediately below the outer circumferential surface 6*a* of the lower end of the pressure roller 6. The exhaust duct 34 is on the left of and adjacent to the cooling duct 26. The rectification plate 20 is above the exhaust duct 34. The left rectification plate 20 is substantially on the tangent line to the outer circumferential surface 6*a* of the lower end of the pressure roller 6. The cooling air 44 blown out of the cooling duct 26 is blown against the outer circumferential surface 6*a* of the lower end of the pressure roller 6 to cool the pressure roller 6. Subsequently or almost simultaneously, the cooling air 44 is blown against the lower face of the rectification plate 20 and is guided to the exhaust duct 34.

The right rectification plate 22 that moves in accordance with movement of the pressure roller 6 is disposed opposite the cooling duct 26. The right rectification plate 22 covers an interval, that is, an opening, between the outer circumferential surface 6*a* of the pressure roller 6 and an upper edge of the right wall 29 of the cooling duct 26. Accordingly, during printing when the pressure roller 6 is pressed against the fixing belt 7 and during off-printing when the pressure roller 6 is isolated from the fixing belt 7 or pressure between the fixing belt 7 and the pressure roller 6 is released, the right interval produced between the cooling duct 26 and the pressure roller 6 is reduced.

The right rectification plate 22 reduces leakage of the cooling air 44 blown out of the cooling duct 26 to a space 79 inside the lower cover 3 right upward along the outer circumferential surface 6*a* of the pressure roller 6. For example, the cooling air 44 sent from the outlet 31*b* of the cooling duct 26 goes round rightward, moves along the right rectification plate 22, blows against and is turned back by the outer circumferential surface 6*a* of a lower right part of the pressure roller 6, and moves leftward along the outer circumferential surface 6*a* of the pressure roller 6, thus cooling the pressure roller 6 effectively.

The right rectification plate 22 reduces leakage of the cooling air 44 from the cooling duct 26 to the space 79 on the upper right of the rectification plate 22, preventing the cooling air 44 from blowing against the sheet 13*a* bearing the unfixed toner image through an interval 78 between the upstream, entry sheet guide plate 11 and the pressure roller 6 and therefore preventing the sheet 13*a* from being jammed. The rectification plate 22 attains this advantage especially when the interval 78 is increased.

Additionally, the cooling air 44 does not leak to the space 79 on the right of the pressure roller 6 inside the lower cover 3, being immune from adversely affecting the temperature sensor 43 situated inside a left space 80 disposed opposite the right space 79 via the pressure roller 6. Even if the temperature sensor 43 is situated in the right space 79, since the cooling air 44 does not blow against the temperature sensor 43, the cooling air 44 does not change the temperature of the temperature sensor 43, retaining detection accuracy of the temperature sensor 43.

During off-printing as well as during printing, that is, before and after the pressure roller 6 moves radially to form the fixing nip 10, the cooling air 44 blown out of the cooling duct 26 moves along the pressure roller 6 and each of the rectification plates 20 and 22 effectively and is exhausted to the outside of the fixing device 1 through the exhaust duct 34.

Figure 7:
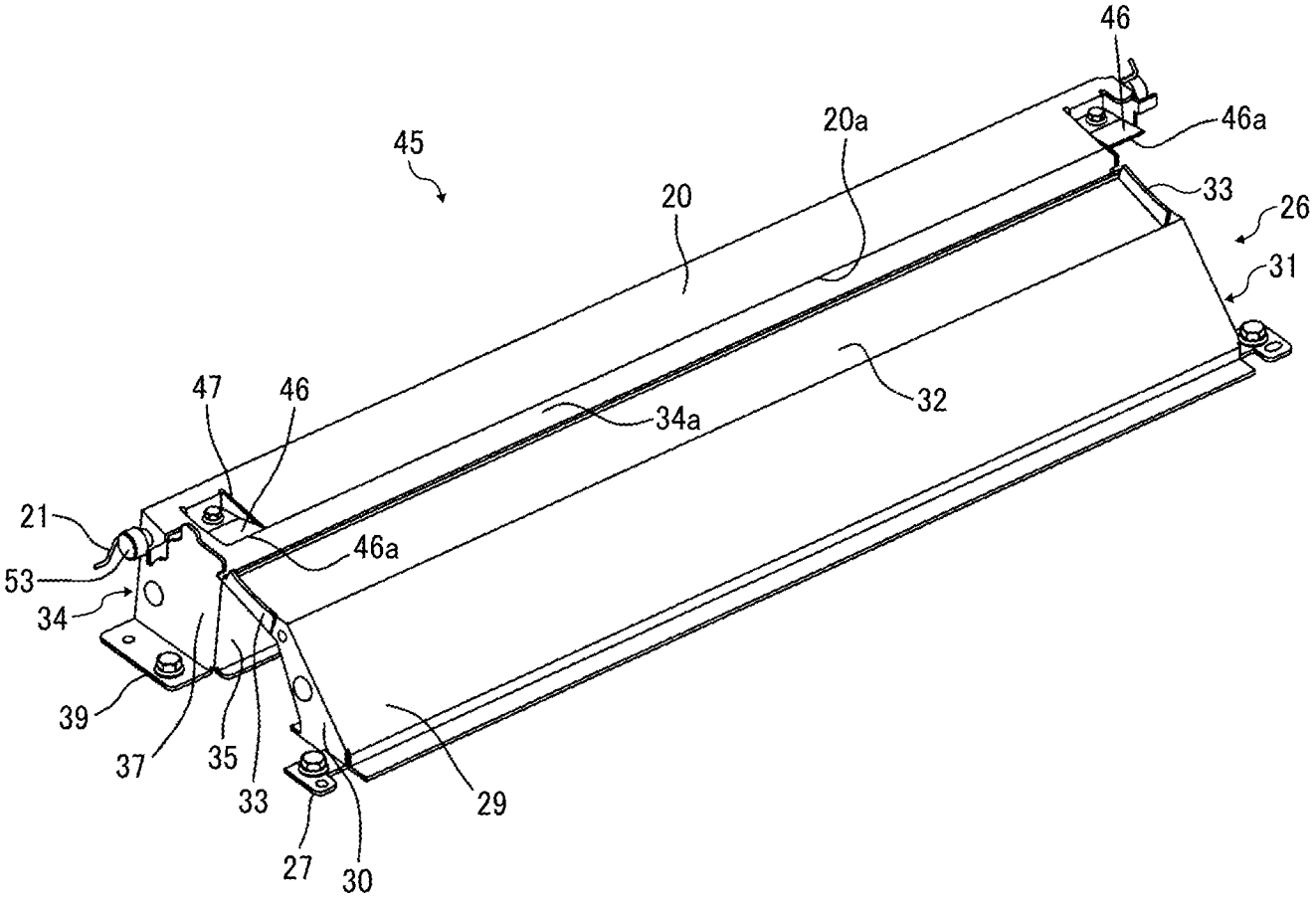
FIG. 7 is a perspective view of a cooler according to one example embodiment of the present disclosure that is incorporated in the fixing device shown in FIG. 3.

With reference to FIG. 7, a description is provided of an example embodiment of the left rectification plate 20 and the cooler 45 incorporating the cooling duct 26 and the exhaust duct 34.

FIG. 7 is a perspective view of the cooler 45. As shown in FIG. 7, the cooler 45 includes at least the cooling duct 26 and the exhaust duct 34. Abutments 46 are mounted on the left rectification plate 20 at both lateral ends, that is, front and rear ends, of the rectification plate 20 in a longitudinal direction thereof, respectively. Each abutment 46 retains a given interval, that is, a narrow slit or a third interval, between the pressure roller 6 depicted in FIG. 3 and the rectification plate 20. The abutment 46 is made of a material that does not damage the pressure roller 6. The abutment 46 is disposed outboard from a conveyance span on the pressure roller 6 in the axial direction thereof where the sheets 13*a* and 13*b* are conveyed. Hence, even if the abutment 46 damages the pressure roller 6, the abutment 46 does not adversely affect quality of the toner image fixed on the sheet 13*b*.

The spring 21 serving as a rectification plate biasing member is anchored to the left rectification plate 20 to bias the abutment 46 against the pressure roller 6. Thus, the spring 21 presses the abutment 46 against the pressure roller 6 with a given bias. The spring 21 is a torsion coil spring surrounding the hinge shaft 53 mounted on the base end, that is, the left end, of the rectification plate 20. Alternatively, instead of the torsion coil spring, a plate spring, a downward tension coil spring, or the like may be used. The rectification plate 20 pivots vertically about the hinge shaft 53 serving as a fulcrum.

A rectangular recess 47 (e.g., a rectangular notch) is disposed at each lateral end, that is, each of the front and rear ends, of the left rectification plate 20 in an axial direction thereof. The abutment 46 is situated inside the recess 47. According to this example embodiment, the abutment 46 is a rectangular plate tilted right upward relative to the substantially horizontal, rectification plate 20. A leading edge 46*a*, that is, a right edge, of the abutment 46 projects upward beyond the rectification plate 20. A base edge, that is, a left edge, of the abutment 46 is fastened to the rectification plate 20 with a bolt or the like.

As shown in FIG. 7, the exhaust duct 34 includes the upper inlet 34*a*, the right wall 35, the front and rear walls 37, and the lower flange 39. The cooling duct 26 includes the projection wall 32, the front and rear side walls 33 contiguous to the projection wall 32, the tube 31, the right wall 29 and the front and rear walls 30 of the tube 31, and the lower flange 27. The lower flanges 27 and 39 are mounted on the bottom wall 24 of the lower cover 3 depicted in FIG. 3.

A description is provided of a construction of a cooler 48 according to another example embodiment that cools the pressure roller 6.

Figure 8:
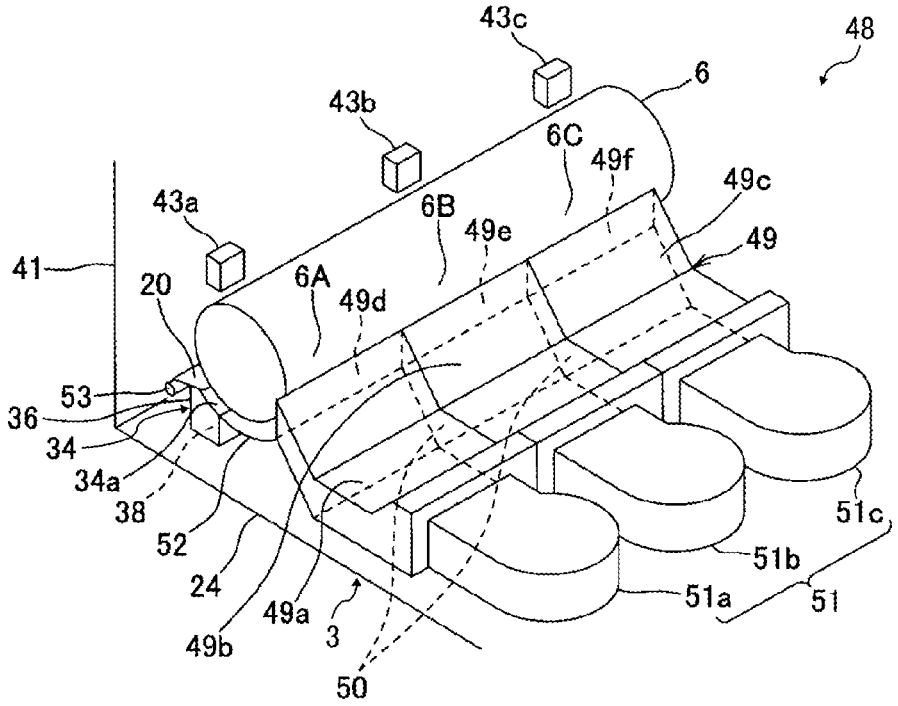
FIG. 8 is a perspective view of a cooler according to another example embodiment of the present disclosure.

FIG. 8 is a perspective view of the cooler 48. Unlike the cooler 45 that inhales the cooling air 44 vertically through the inlet 31*a* disposed at the bottom of the cooler 45 as shown in FIG. 3, the cooler 48 depicted in FIG. 8 inhales cooling air horizontally like the cooling duct 71 installed in the comparative fixing device 61 depicted in FIG. 5. However, the construction of the cooler 48 described below is also applicable to the cooler 45 depicted in FIG. 3. FIG. 8 illustrates the left rectification plate 20. A description of the right rectification plate 22 is deferred with reference to FIG. 16.

As shown in FIG. 8, an oblong cooling duct 49 that cools the pressure roller 6 is on the right of the pressure roller 6. The cooling duct 49 accommodates a plurality of partitions, that is, two partitions 50 according to this example embodiment, to create three compartments inside the cooling duct 49, preventing cooling air from blowing against a portion of the pressure roller 6 where cooling is unnecessary. Thus, the cooling duct 49 may be constructed of a plurality of downsized cooling ducts 49*a*, 49*b*, and 49*c* aligned in the axial direction of the pressure roller 6.

On the right of the cooling duct 49 is a cooling blower 51 abutting the cooling duct 49 to send cooling air to the cooling duct 49. The cooling blower 51 includes three blowers, that is, a front cooling blower 51*a*, a center cooling blower 51*b*, and a rear cooling blower 51*c*, aligned in the axial direction of the pressure roller 6 with an identical interval between the two adjacent blowers. The front cooling blower 51*a*, the center cooling blower 51*b*, and the rear cooling blower 51*c* are disposed opposite a front span 6A, a center span 6B, and a rear span 6C on the pressure roller 6 in the axial direction, that is, a longitudinal direction, thereof, respectively.

For example, when the temperature of the center span 6B on the pressure roller 6 is decreased to a temperature below a given temperature as a plurality of small sheets, that is, sheets of a decreased size, is conveyed over the center span 6B on the pressure roller 6 continuously, the center cooling blower 51*b* is stopped or weakened to increase and recover the temperature of the center span 6B on the pressure roller 6. When the temperature of the front span 6A and the center span 6B on the pressure roller 6 is decreased to a temperature below the given temperature as a plurality of medium sheets, that is, a plurality of sheets of a medium size, is conveyed over the front span 6A and the center span 6B on the pressure roller 6 continuously, the front cooling blower 51*a* and the center cooling blower 51*b* are stopped or weakened. When the temperature of the front span 6A and the rear span 6C on the pressure roller 6 is increased to a temperature above the given temperature, the front cooling blower 51*a* and the rear cooling blower 51*c* are actuated or strengthened preferentially.

As described above, the cooler 48 includes the front cooling blower 51*a*, the center cooling blower 51*b*, and the rear cooling blower 51*c* that are selectively actuated according to the temperature of the pressure roller 6. A controller (e.g., a processor), that is, a central processing unit (CPU) provided with a random-access memory (RAM) and a read-only memory (ROM), for example, operatively connected to a front temperature sensor 43*a*, a center temperature sensor 43*b*, a rear temperature sensor 43*c*, the front cooling blower 51*a*, the center cooling blower 51*b*, and the rear cooling blower 51*c*, selectively turns on and off the front cooling blower 51*a*, the center cooling blower 51*b*, and the rear cooling blower 51*c* based on a detection signal sent from the front temperature sensor 43*a*, the center temperature sensor 43*b*, and the rear temperature sensor 43*c* disposed in proximity to the front span 6A, the center span 6B, and the rear span 6C on the pressure roller 6, respectively.

On the left of the pressure roller 6 are three temperature sensors, that is, the front temperature sensor 43*a*, the center temperature sensor 43*b*, and the rear temperature sensor 43*c*, disposed opposite and in proximity to the front span 6A, the center span 6B, and the rear span 6C on the pressure roller 6, respectively. The front temperature sensor 43*a*, the center temperature sensor 43*b*, and the rear temperature sensor 43*c* are aligned in the axial direction of the pressure roller 6, constituting the temperature sensor 43 serving as a temperature detector that detects the temperature of the pressure roller 6. The front temperature sensor 43*a*, the center temperature sensor 43*b*, and the rear temperature sensor 43*c* detect the temperature of the outer circumferential surface 6*a* of the pressure roller 6 in the front span 6A, the center span 6B, and the rear span 6C thereon, controlling an amount of cooling air blown against the pressure roller 6 from the front cooling blower 51*a*, the center cooling blower 51*b*, and the rear cooling blower 51*c*, respectively.

The left rectification plate 20 pivots about the hinge shaft 53 disposed at the left end of the rectification plate 20 vertically. A construction of the left rectification plate 20 shown in FIG. 8 is equivalent to that of the left rectification plate 20 shown in FIG. 3 and therefore a description thereof is omitted. FIG. 8 illustrates the lower cover 3 and the bottom wall 24 and the left wall 41 of the lower cover 3.

Cooling air from the front cooling blower 51*a*, the center cooling blower 51*b*, and the rear cooling blower 51*c* blows against the pressure roller 6, cools the outer circumferential surface 6*a* of the pressure roller 6, and is exhausted from the exhaust duct 34 through the outlet 38 penetrating through the bottom wall 24 of the lower cover 3 to the outside of the fixing device 1. A construction of the exhaust duct 34 shown in FIG. 8 is equivalent to that of the exhaust duct 34 shown in FIG. 3 and therefore a description thereof is omitted. Cooling air blown out through a front outlet 49*d*, a center outlet 49*e*, and a rear outlet 49*f* of the cooling duct 49 is blown against the outer circumferential surface 6*a* of a part abutting the lower end of the pressure roller 6 and guided to the upper inlet 34*a* of the exhaust duct 34 along a curved guide plate 52 situated below the pressure roller 6. The cooling air blown out from the cooling duct 49 is directed to the left rectification plate 20.

The left rectification plate 20 that moves vertically in accordance with movement of the pressure roller 6 is disposed in proximity to the exhaust duct 34 to decrease the interval between the outer circumferential surface 6*a* of the pressure roller 6 and the upper edge 36*a* depicted in FIG. 3 of the left wall 36 of the exhaust duct 34 during printing when the pressure roller 6 is pressed against the fixing belt 7 and during off-printing when the pressure roller 6 is isolated from the fixing belt 7 or pressure between the fixing belt 7 and the pressure roller 6 is released. Accordingly, cooling air travels along the outer circumferential surface 6*a* of the pressure roller 6 effectively, thus cooling the pressure roller 6 efficiently.

The decreased interval between the exhaust duct 34 and the pressure roller 6 prevents leakage of cooling air from the interval between the exhaust duct 34 and the pressure roller 6. Accordingly, the cooling air does not travel through the interval between the exit sheet guide plate 12 and the pressure roller 6 and therefore does not blow against the sheet 13*b* bearing the fixed toner image, preventing the sheet 13*b* from being jammed. Additionally, since the cooling air does not blow against the temperature sensor 43, the cooling air does not change the temperature of the temperature sensor 43, retaining detection accuracy of the temperature sensor 43 properly.

The plurality of cooling blowers shown in FIG. 8, that is, the front cooling blower 51*a*, the center cooling blower 51*b*, and the rear cooling blower 51*c*, the plurality of partitions 50 defining the plurality of cooling ducts, that is, the front cooling duct 49*a*, the center cooling duct 49*b*, and the rear cooling duct 49*c*, inside the cooling duct 49, and the plurality of temperature sensors, that is, the front temperature sensor 43*a*, the center temperature sensor 43*b*, and the rear temperature sensor 43*c*, aligned in the axial direction of the pressure roller 6 are also applicable to the cooler 45 of the fixing device 1 shown in FIGS. 3 and 7. For example, the oblong cooling duct 26 of the cooler 45 depicted in FIG. 7 may be divided into three compartments defined by the partitions 50 inside the cooling duct 26. The cooling duct 26 may incorporate three outlets 31*b* shown in FIG. 3. The three outlets 31*b* may be disposed opposite the front span 6A, the center span 6B, and the rear span 6C on the pressure roller 6, respectively.

Three cooling blowers may be in communication with three inlets 31*a* depicted in FIG. 3, that is, openings, corresponding to the three outlets 31*b*, respectively. The front temperature sensor 43*a*, the center temperature sensor 43*b*, and the rear temperature sensor 43*c* may be disposed opposite the front span 6A, the center span 6B, and the rear span 6C on the pressure roller 6, respectively. Instead of dividing an interior of the oblong cooling duct 26, three downsized cooling ducts equivalent to the front cooling duct 49*a*, the center cooling duct 49*b*, and the rear cooling duct 49*c* depicted in FIG. 8, respectively, may be aligned in the axial direction of the pressure roller 6.

Figure 9:
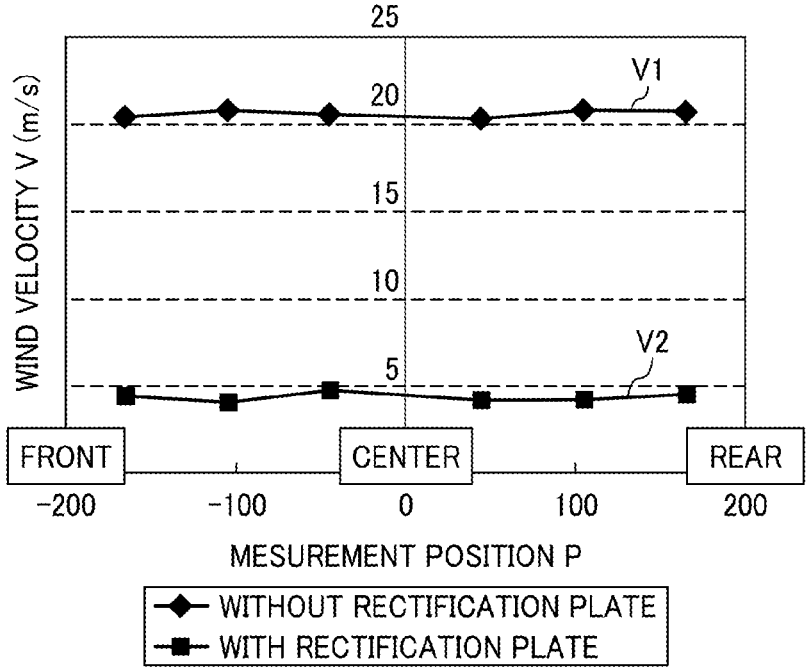
FIG. 9 is a graph showing one example of results of a measurement for measuring a wind velocity of cooling air at an interval between a pressure roller and an exit sheet guide plate in a configuration with rectification plates incorporated in the fixing device shown in FIG. 3 and in a comparative configuration without the rectification plates.

FIG. 9 is a graph showing one example of results of a measurement for measuring a wind velocity V of the cooling air 44 at the interval between the pressure roller 6 and the exit sheet guide plate 12 shown in FIG. 3 in a configuration with the rectification plates 20 and 22 and in a comparative configuration without the rectification plates 20 and 22. In FIG. 9, a vertical axis represents the wind velocity V. A horizontal axis represents a measurement position P, that is, a front position, a center position, and a rear position on the pressure roller 6 in the axial direction thereof.

Without the left rectification plate 20, the cooling air 44 is exhausted through the interval between the pressure roller 6 and the exit sheet guide plate 12 at an increased wind velocity V1. Accordingly, the cooling air 44 blows against the sheet 13*b* conveyed over the exit sheet guide plate 12, degrading motion of the sheet 13*b* and resulting in jamming of the sheet 13*b*.

To address this circumstance, the left rectification plate 20 suppresses leakage of the cooling air 44 through the interval between the pressure roller 6 and the exit sheet guide plate 12, causing the cooling air 44 to travel at a decreased wind velocity V2 and therefore preventing the sheet 13*b* from being jammed by the cooling air 44.

Figure 10:
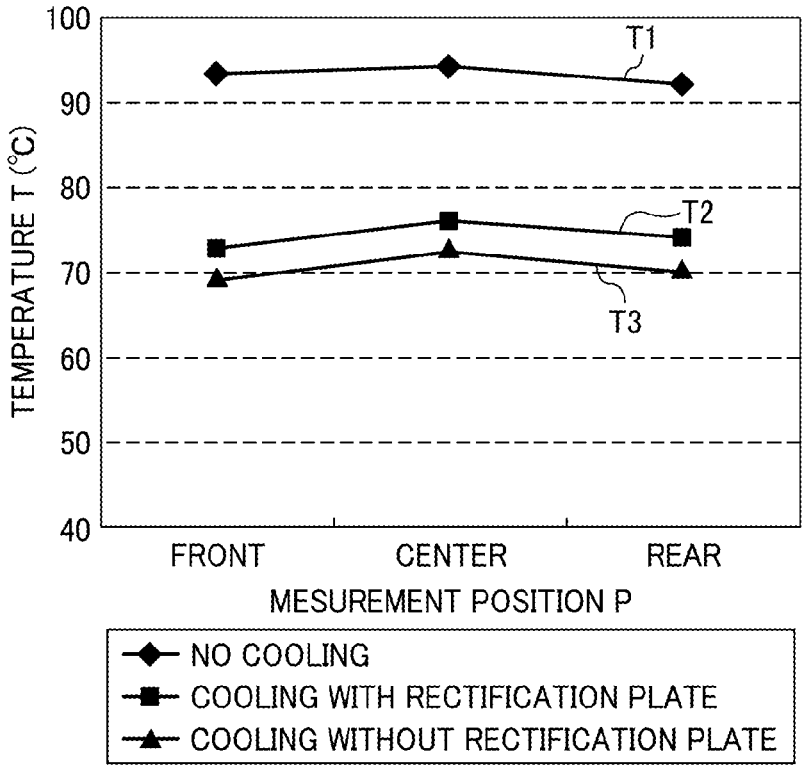
FIG. 10 is a graph showing one example of change in a temperature of an outer circumferential surface of the pressure roller that is detected by a temperature sensor in the configuration with the rectification plates and the comparative configuration without the rectification plates.

FIG. 10 is a graph showing one example of change in a temperature T of the outer circumferential surface 6*a* of the pressure roller 6 that is detected by the temperature sensor 43 in a configuration with the rectification plates 20 and 22 and a comparative configuration without the rectification plates 20 and 22. In FIG. 10, a vertical axis represents the temperature T of the outer circumferential surface 6*a* of the pressure roller 6. A horizontal axis represents the measurement position P, that is, the front position, the center position, and the rear position on the pressure roller 6 in the axial direction thereof. As the cooling air 44 cools the pressure roller 6, the temperature of the outer circumferential surface 6*a* of the pressure roller 6 decreases to a temperature T2 from a temperature T1.

When the left rectification plate 20 disposed opposite the exhaust duct 34 moves vertically in accordance with movement of the pressure roller 6 as the pressure roller 6 is pressed against the fixing belt 17 or pressure between the fixing belt 17 and the pressure roller 6 is released, the cooling air 44 does not affect the temperature sensor 43. Accordingly, an actual temperature of the pressure roller 6 does not differ from the temperature of the pressure roller 6 detected by the temperature sensor 43. The temperature sensor 43 detects temperatures of the pressure roller 6 near the temperature T2.

In the comparative configuration without the rectification plates 20 and 22, the temperature sensor 43 may detect a temperature T3 lower than the actual temperature of the pressure roller 6 due to cooling air blowing against the temperature sensor 43. The temperature sensor 43 is requested to attain a target detection accuracy of plus or minus a degrees centigrade deviated from the actual temperature of the pressure roller 6. If the temperature sensor 43 detects the temperature T3, the temperature sensor 43 does not attain the target detection accuracy due to variation in detection accuracy. To address this circumstance, the rectification plates 20 and 22 installed in the fixing device 1 suppress the cooling air 44 that enters spaces above the rectification plates 20 and 22, respectively, inside the fixing device 1, attaining an even temperature inside the fixing device 1. Accordingly, the rectification plates 20 and 22 suppress change in the temperature of the pressure roller 6 detected by the temperature sensor 43 due to the cooling air 44, thus attaining the target detection accuracy.

Figure 11:
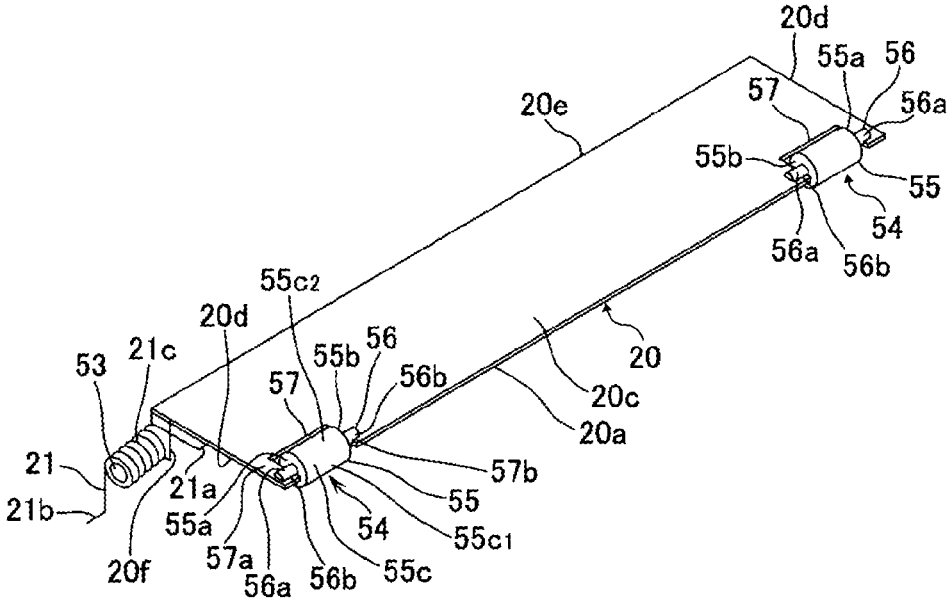
FIG. 11 is a perspective view of the rectification plate and an abutment mounted thereon installable in the fixing device shown in FIG. 3.

With reference to FIG. 11, a description is provided of a construction of an abutment applicable to the left rectification plate 20.

FIG. 11 is a perspective view of the rectification plate 20 and the abutment. Unlike the platy abutment 46 shown in FIG. 7, the abutment shown in FIG. 11 is a rotary body 55. The rotary body 55 is cylindrical or tubular and made of synthetic resin. A shaft 56 made of metal or synthetic resin penetrates through an axis of the rotary body 55. The rotary body 55 and the shaft 56 constitute a rotary body unit 54. Like the abutment 46 shown in FIG. 7, the rotary body 55 is disposed at each lateral end, that is, the front end and the rear end, of the rectification plate 20 in the longitudinal direction thereof.

The rotary body 55 is rotatably supported by the rectification plate 20 through the shaft 56 mounted on the rectification plate 20. For example, a shaft portion 56*a* having a slit 56*b* projects from each of an outboard face 55*a* and an inboard face 55*b* of the rotary body 55 horizontally. A rectangular recess 57 is disposed at each lateral end, that is, the front end and the rear end, of the rectification plate 20 in the longitudinal direction thereof to accommodate the rotary body 55. Each of an outboard fringe 57*a* and an inboard fringe 57*b* of the recess 57 engages the slit 56*b* of the shaft portion 56*a* to mount the shaft portion 56*a* on the rectification plate 20. Alternatively, the shaft portion 56*a* may be adhered to each of the fringes 57*a* and 57*b* by welding or the like. Yet alternatively, the shaft 56 may be mounted on the rectification plate 20 by various mechanisms other than the slit 56*b*.

The rotary body 55 projects from the recess 57 beyond the rectification plate 20 radially. For example, a right end 55*c*1 of an outer circumferential surface 55*c* of the rotary body 55 projects slightly rightward or outboard beyond a right edge of the recess 57 corresponding to the leading edge 20*a*, that is, a free end, of the rectification plate 20. An upper end 55*c*2 of the outer circumferential surface 55*c* of the rotary body 55 projects substantially upward or outboard beyond an upper edge of the recess 57 corresponding to the upper face 20*c* of the rectification plate 20. The rectification plate 20 is made of metal or synthetic resin.

Since the pressure roller 6 contacts an upper face of the leading edge 20*a* of the left rectification plate 20 as shown in FIG. 3, the outer circumferential surface 55*c* of an upper portion of the rotary body 55 spanning from a top to a right end in FIG. 11 contacts the outer circumferential surface 6*a* of the lower end of the pressure roller 6. It is preferable that the rotary body 55 serving as an abutment is disposed at the leading edge 20*a* of the rectification plate 20.

The outer circumferential surface 55*c* of the pair of front and rear rotary bodies 55 contacts the outer circumferential surface 6*a* of the pressure roller 6 to retain the given interval, that is, the third interval, between the pressure roller 6 and the left rectification plate 20. Since the rotary body 55 rotates as the outer circumferential surface 55*c* of the rotary body 55 contacts the outer circumferential surface 6*a* of the pressure roller 6, the rotary body 55 reduces friction between the pressure roller 6 and the rotary body 55, preventing abrasion of the outer circumferential surface 6*a* of the pressure roller 6 at a contact portion of the pressure roller 6 that contacts the rotary body 55. The rotary body 55 rotates in a direction opposite a rotation direction D6 depicted in FIG. 3 of the pressure roller 6 by friction between the rotary body 55 and the outer circumferential surface 6*a* of the pressure roller 6.

The rotary body 55 is made of an abrasion resistant material that does not damage the pressure roller 6. For example, the rotary body 55 is made of polytetrafluoroethylene or tetrafluoro resin (PFA). Alternatively, polytetrafluoroethylene (PTFE), tetrafluoroethylene-hexafluoropropylene copolymer (FEP), ethylene tetrafluoroethylene (EFTE), or the like may be used as tetrafluoro resin. Instead of tetrafluoro resin, abrasion resistant, synthetic resin or the like may be used as a material of the rotary body 55.

The spring 21 (e.g., the torsion coil spring) serving as a biasing member biases the leading edge 20*a*, that is, the free end provided with the rotary bodies 55, of the left rectification plate 20 upward. The spring 21 biases the outer circumferential surface 55*c* of the upper end 55*c*2 of the rotary body 55 against the outer circumferential surface 6*a* of the lower end of the pressure roller 6 constantly.

As shown in FIG. 11, a projection 21*a* at one end of the spring 21 presses against the lower face of the rectification plate 20. A projection 21*b* at another end of the spring 21 is anchored to each of the front and rear walls 37 of the exhaust duct 34 depicted in FIG. 7 or an outboard component disposed outboard from each of the front and rear walls 37, for example. As shown in FIG. 11, the horizontal hinge shaft 53 is inserted into a coil 21*c* of the spring 21. The hinge shaft 53 is mounted on a side wall 20*f* disposed at the left end of the left rectification plate 20. The spring 21 is disposed at each lateral end, that is, the front end and the rear end, of the rectification plate 20 in the longitudinal direction thereof.

The side wall 20*f* is contiguous to a short edge 20*d* disposed at each lateral end, that is, the front end and the rear end, of the left rectification plate 20 in the longitudinal direction thereof. The pair of rotary bodies 55, that is, the front rotary body 55 and the rear rotary body 55, is disposed at the right leading edge 20*a*, that is, the free end or one long edge, of the rectification plate 20. A left trailing edge 20*e*, that is, another long edge, of the rectification plate 20 is contiguous to a vertical low left wall projecting downward from the trailing edge 20*e* as shown in FIG. 3. A lower edge of the left wall constitutes the base end 20*b*.

As shown in FIG. 3, the rotary body 55 serving as an abutment may be disposed at the upper edge of the sloped wall 22*c*, that is, a junction 22*e* of the sloped wall 22*c* and the head wall 22*a*. The rotary body 55 situated at the upper edge of the sloped wall 22*c* contacts the outer circumferential surface 6*a* of the lower right part of the pressure roller 6. The right rectification plate 22 is leveled with the left rectification plate 20 in height. The spring 21 serving as a biasing member biases the right rectification plate 22 against the pressure roller 6 such that the head wall 22*a* of the rectification plate 22 contacts the outer circumferential surface 6*a* of the pressure roller 6 constantly and the rectification plate 22 is pivotable counterclockwise in FIG. 3.

Like the left rectification plate 20, the right rectification plate 22 has a length equivalent to a length of the pressure roller 6 in the axial direction thereof.

Figure 12:
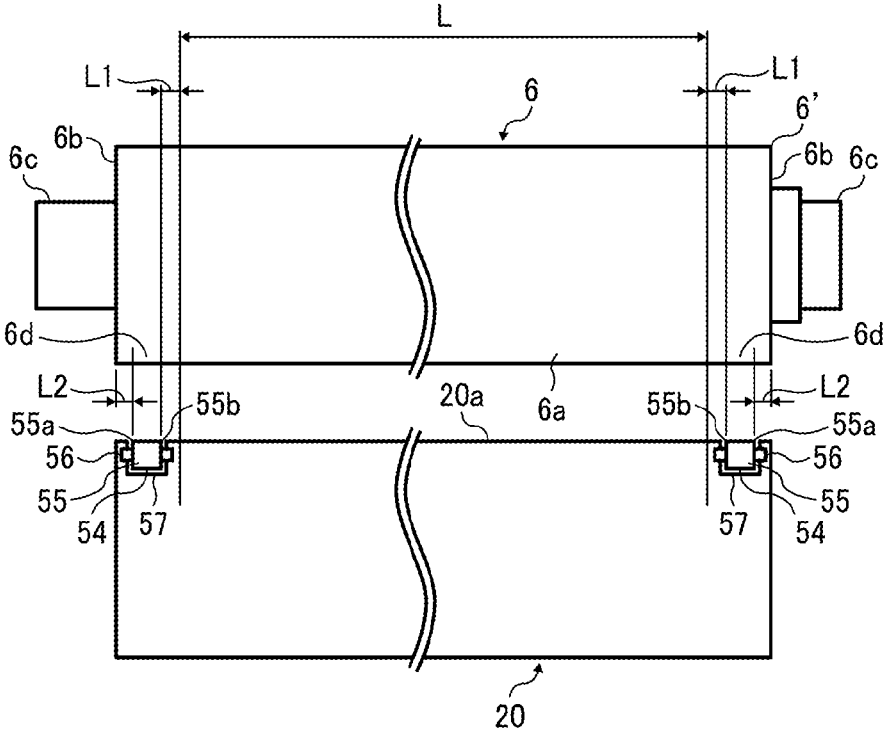
FIG. 12 is a plan view of the pressure roller and the rectification plate shown in FIG. 11.

With reference to FIG. 12, a description is provided of one example of a positional relation between the rotary bodies 55 provided on the left rectification plate 20 and the pressure roller 6.

FIG. 12 is a plan view of the pressure roller 6 and the rectification plate 20. FIG. 12 illustrates the rectification plate 20 isolated from the pressure roller 6 for the purpose of explanation. However, the rotary bodies 55 disposed on the rectification plate 20 contact the outer circumferential surface 6*a* of the pressure roller 6 constantly.

The pair of front and rear rotary bodies 55 is disposed outboard from a conveyance span L on the pressure roller 6 where the sheets 13*a* and 13*b* are conveyed by a length L1 in the axial direction of the pressure roller 6. The inboard face 55*b*, that is, a rear face of the front rotary body 55 and a front face of the rear rotary body 55, of each rotary body 55 is disposed outboard from the conveyance span L by the length L1 in the axial direction of the pressure roller 6.

The length L1 is determined based on the position of the pressure roller 6 and the rectification plate 20 installed in the fixing device 1 and variation of the conveyance span L on the pressure roller 6. For example, the length L1 is about 2 mm plus or minus 1 mm. Accordingly, the rotary bodies 55 prevent abrasion of the pressure roller 6 due to contact with the sheets 13*a* and 13*b* and the rotary bodies 55. Additionally, even if the rotary bodies 55 damage the pressure roller 6, the pressure roller 6 does not degrade quality of the toner image fixed on the sheet 13*b*.

Each rotary body 55 is disposed inboard from a lateral edge face 6*b*, that is, a front lateral edge face and a rear lateral edge face, of an elastic roller body 6' of the pressure roller 6 by a length L2 in the axial direction of the pressure roller 6. The outboard face 55*a*, that is, a front face of the front rotary body 55 and a rear face of the rear rotary body 55, of each rotary body 55 is disposed inboard from the lateral edge face 6*b* of the pressure roller 6 by the length L2 in the axial direction of the pressure roller 6.

The length L2 is determined based on variation in installation dimension of the pressure roller 6 and the rectification plate 20. For example, the length L2 is about 1.5 mm plus or minus 1 mm. Each rotary body 55 disposed inboard from the lateral edge face 6*b* of the pressure roller 6 is not affected by variation in dimension at each lateral end of the pressure roller 6 in the axial direction thereof, retaining the given interval between the pressure roller 6 and the left rectification plate 20.

As described above, by adjusting the shape, the material, and the position of the rotary bodies 55 rotatably mounted on the rectification plate 20 that moves in accordance with movement of the pressure roller 6 between the fixing position, that is, a pressurization position, where the pressure roller 6 is pressed against the fixing belt 7 and the isolation position, that is, a depressurization position, where pressure between the fixing belt 7 and the pressure roller 6 is released, abrasion of the pressure roller 6 and the rotary bodies 55 is suppressed. Additionally, degradation in precision, that is, variation, of the interval between the pressure roller 6 and the rectification plate 20 that may result from abrasion of the pressure roller 6 and the rotary bodies 55 is prevented, maintaining precision of the interval. Such advantages are also applicable to the right rectification plate 22.

Additionally, adjustment in the position of the rotary bodies 55 with respect to the pressure roller 6 maintains precision of the interval between the pressure roller 6 and the rectification plate 20. Accordingly, the rotary bodies 55 prevent abrasion of the pressure roller 6 due to contact with the sheets 13*a* and 13*b* during printing and the rotary bodies 55, maintaining precision of the interval between the pressure roller 6 and the rectification plate 20. Additionally, each rotary body 55 is pressed against the outer circumferential surface 6*a* of each lateral end 6*d* of the pressure roller 6 in the axial direction thereof, not each lateral edge face 6*b*, that is, the front and rear lateral edge faces of the elastic roller body 6', susceptible to bending, preventing each rotary body 55 from deviating from each lateral edge face 6*b* outward in the axial direction of the pressure roller 6 and thereby maintaining precision of the interval between the pressure roller 6 and the rectification plate 20. Further, each rotary body 55 is disposed outboard from the conveyance span L on the pressure roller 6 in the axial direction thereof, preventing abrasion or damage of the pressure roller 6 in the conveyance span L. Such advantages are also applicable to the right rectification plate 22.

For example, if the pressure roller 6 suffers from substantial abrasion due to contact with the rotary bodies 55, the interval between the pressure roller 6 and the rectification plate 20 may disappear and the rectification plate 20 may contact the pressure roller 6 directly, damaging the outer circumferential surface 6*a* of the pressure roller 6. To address this circumstance, abrasion of the pressure roller 6 by contact with the rotary bodies 55 is prevented to retain the given interval, that is, the third interval, between the pressure roller 6 and the rectification plate 20, preventing the rectification plate 20 from coming into contact with the pressure roller 6 and thereby preventing the rectification plate 20 from damaging the outer circumferential surface 6*a* of the pressure roller 6.

The given slit interval between the pressure roller 6 and the rectification plate 20 is retained constantly to maintain a slight amount of the cooling air 44 leaking through the slit interval to the temperature sensor 43 constantly, eliminating variation in the temperature of the pressure roller 6 detected by the temperature sensor 43. The interval between the pressure roller 6 and the rectification plate 20 is a slight slit. The rectification plate 20 produces the interval between the pressure roller 6 and the rectification plate 20 that is smaller than the interval, that is, the opening, between the pressure roller 6 and the upper edge 36*a* of the left wall 36 of the exhaust duct 34 that is produced if the rectification plate 20 is not installed, allowing leakage of the cooling air 44 in a slight amount. Such advantages are also applicable to the right rectification plate 22.

The left rectification plate 20 mounted with the rotary bodies 55 depicted in FIGS. 11 and 12 is disposed opposite the exhaust duct 34 of the cooler 45 incorporating the cooling duct 26 shown in FIG. 7 elongated in the axial direction of the pressure roller 6. The left rectification plate 20 shown in FIGS. 11 and 12 is also disposed opposite the exhaust duct 34 of the cooler 48 incorporating the plurality of cooling ducts, that is, the front cooling duct 49*a*, the center cooling duct 49*b*, and the rear cooling duct 49*c* shown in FIG. 8, aligned in the axial direction of the pressure roller 6. The left rectification plate 20 shown in FIGS. 11 and 12 is also disposed opposite the exhaust duct 34 of the cooler 45 incorporating the cooling duct 26 shown in FIG. 7 that is equivalent to the cooling duct 49 incorporating the two partitions 50 shown in FIG. 8 aligned in the axial direction of the pressure roller 6. FIG. 12 illustrates a metal shaft 6*c* that supports the tubular, elastic roller body 6' of the pressure roller 6.

Like the rotary body 55 shown in FIG. 12, each abutment 46 mounted on the rectification plate 20 shown in FIG. 7 contacts the pressure roller 6 in a span disposed outboard from the conveyance span L by the length L1 and inboard from each lateral edge face 6*b*, that is, the front and rear lateral edge faces, of the pressure roller 6 by the length L2 in the axial direction of the pressure roller 6.

Figure 13:
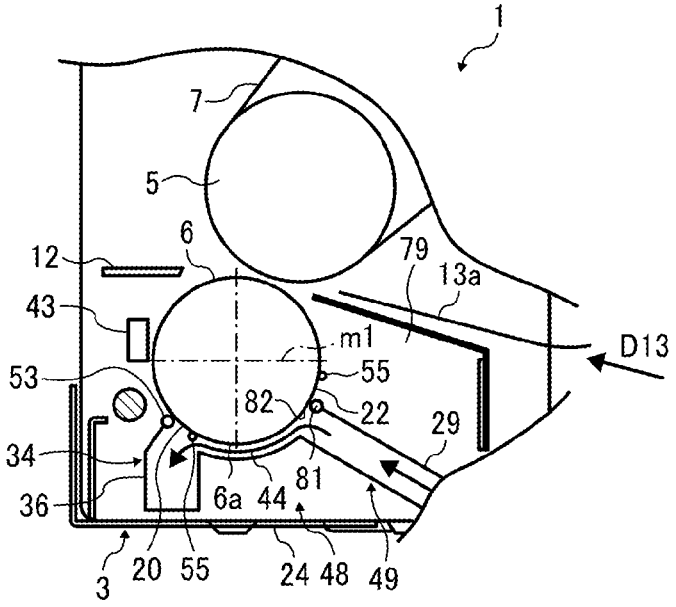
FIG. 13 is a partial vertical sectional view of the rectification plate shown in FIG. 11 when the pressure roller is isolated from the fixing belt.

With reference to FIG. 13, a description is provided of a configuration of the left rectification plate 20 and the right rectification plate 22 of the cooler 48 depicted in FIG. 8 when the pressure roller 6 is lowered and isolated from the fixing belt 7 or pressure between the fixing belt 7 and the pressure roller 6 is released.

FIG. 13 is a partial vertical sectional view of the cooler 48, the pressure roller 6, and the fixing belt 7. As shown in FIG. 13, the pressure roller 6 presses down the left rectification plate 20 obliquely left downward to pivot the rectification plate 20 about the hinge shaft 53 mounted on the upper end of the left wall 36 of the exhaust duct 34 as the spring 21 biases the rectification plate 20 upward, thus tilting the rectification plate 20 right downward. Each rotary body 55 disposed at the leading edge 20*a* of the rectification plate 20 contacts the outer circumferential surface 6*a* of the lower left part of the pressure roller 6.

Conversely, the pressure roller 6 presses the right rectification plate 22 slightly rightward to pivot the rectification plate 22 about a hinge shaft 81 disposed at the upper end of the right wall 29, that is, a sloped upper wall, of the cooling duct 49 as the spring 21 biases the rectification plate 22 leftward, thus tilting the rectification plate 22 right upward. Each rotary body 55 disposed at the leading edge, that is, the head wall 22*a*, of the rectification plate 22 contacts the outer circumferential surface 6*a* of a lower right half part of the pressure roller 6 at a position in proximity to a diametrical line ml of the pressure roller 6 extending horizontally.

While the pressure roller 6 is isolated from the fixing belt 7, the upper edge of the right wall 29 of the cooling duct 49 and the hinge shaft 81 in proximity to the upper edge of the right wall 29 are situated in proximity to the outer circumferential surface 6*a* of the right part of the pressure roller 6. While the pressure roller 6 is isolated from the fixing belt 7, even without the right rectification plate 22, the upper edge of the right wall 29 of the cooling duct 49 is in proximity to the pressure roller 6, suppressing production of an interval 82 between the pressure roller 6 and the right wall 29. Accordingly, the cooling air 44 blowing against the pressure roller 6 from the cooling duct 49 does not leak through the interval 82 between the upper edge of the right wall 29 of the cooling duct 49 and the outer circumferential surface 6*a* of the right part of the pressure roller 6 to an upper space inside the fixing device 1. If the fixing device 1 incorporates the right rectification plate 22, the rectification plate 22 suppresses leakage of the cooling air 44 effectively. The cooling air 44 travels mostly along the outer circumferential surface 6*a* of the lower part of the pressure roller 6 and the left rectification plate 20 and is exhausted through the exhaust duct 34 to the outside of the fixing device 1.

FIG. 13 illustrates the temperature sensor 43, the sheet 13*a* situated upstream from the pressure roller 6 in the sheet conveyance direction D13, the exit sheet guide plate 12 disposed downstream from the pressure roller 6 in the sheet conveyance direction D13, and the lower cover 3 of the fixing device 1. The cooling duct 49 may communicate with the inlet 25 depicted in FIG. 3 penetrating through the bottom wall 24 of the lower cover 3 and the space 79 inside the lower cover 3.

Figure 14:
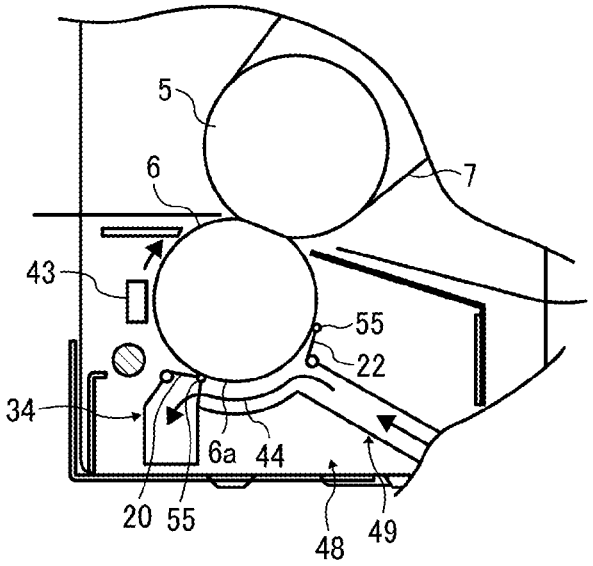
FIG. 14 is a partial vertical sectional view of the rectification plate shown in FIG. 11 when the pressure roller is pressed against the fixing belt.

With reference to FIG. 14, a description is provided of a configuration of the left rectification plate 20 and the right rectification plate 22 of the cooler 48 when the pressure roller 6 is lifted obliquely right upward from the depressurization position shown in FIG. 13 and pressed against the fixing belt 7.

FIG. 14 is a partial vertical sectional view of the cooler 48, the pressure roller 6, and the fixing belt 7. As the pressure roller 6 is lifted, the spring 21 biases and lifts the left rectification plate 20, placing the rectification plate 20 substantially horizontally. Each rotary body 55 disposed at the leading edge 20*a* of the rectification plate 20 contacts the outer circumferential surface 6*a* of the lower left part of the pressure roller 6, decreasing an interval between the rectification plate 20 and the outer circumferential surface 6*a* of the pressure roller 6. The spring 21 biases and pivots the right rectification plate 22 slightly leftward to bring each rotary body 55 disposed at the leading edge, that is, the head wall 22*a*, of the rectification plate 22 into contact with the outer circumferential surface 6*a* of the right part of the pressure roller 6, decreasing an interval between the rectification plate 22 and the outer circumferential surface 6*a* of the pressure roller 6.

The cooling air 44 blowing out of the cooling duct 49 travels along the right rectification plate 22 upward, blows against and is turned back by the outer circumferential surface 6*a* of the right part of the pressure roller 6, and moves leftward along the outer circumferential surface 6*a* of a lower part of the pressure roller 6. The cooling air 44 traveling along the outer circumferential surface 6*a* of the lower part of the pressure roller 6 cools the pressure roller 6 and is guided along the left rectification plate 20 to the exhaust duct 34. As the pressure roller 6 is lifted, the right rectification plate 22 suppresses production of an interval, that is, an opening, between the cooling duct 49 and the outer circumferential surface 6*a* of the right part of the pressure roller 6. Simultaneously, the left rectification plate 20 suppresses production of an interval, that is, an opening, between the exhaust duct 34 and the outer circumferential surface 6*a* of a left part of the pressure roller 6. Thus, the rectification plates 20 and 22 suppress leakage of the cooling air 44 from the left interval between the exhaust duct 34 and the outer circumferential surface 6*a* of the pressure roller 6 and the right interval between the cooling duct 49 and the outer circumferential surface 6*a* of the pressure roller 6, respectively, to the upper space inside the fixing device 1.

Figure 15:
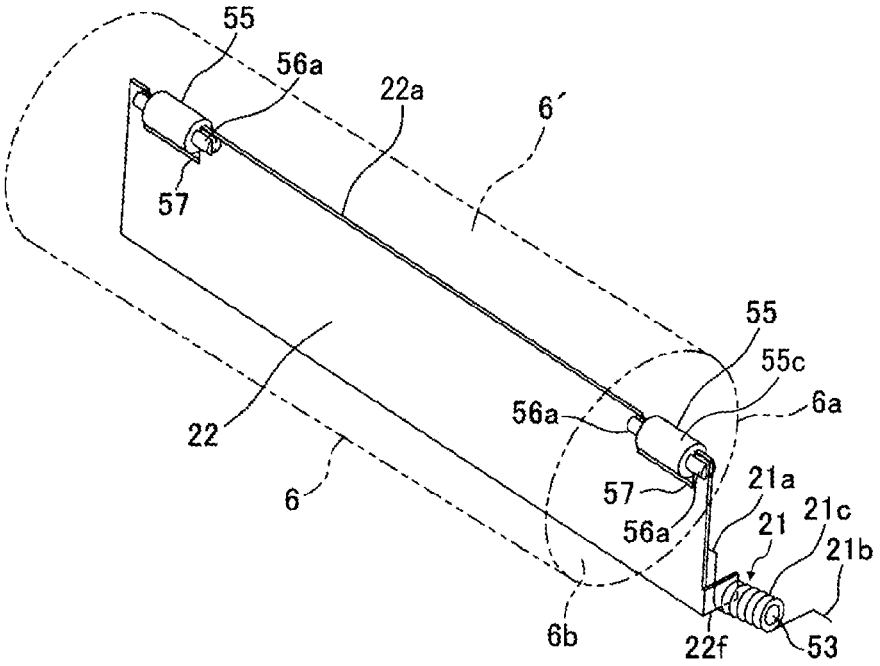
FIG. 15 is a perspective view of the rectification plate installable in the fixing device shown in FIG. 3.

With reference to FIG. 15, a description is provided of one example of a configuration of the right rectification plate 22 that corresponds to the left rectification plate 20 shown in FIG. 11.

FIG. 15 is a perspective view of the rectification plate 22. FIG. 15 illustrates the pressure roller 6 in the dotted line. It is to be noted that identical reference numerals are assigned to components shown in FIG. 15 that are identical to the components shown in FIG. 11 and a description of the identical components is omitted.

The spring 21 (e.g., a torsion coil spring) biases the right rectification plate 22 to reach and abut the outer circumferential surface 6*a* of the right part of the pressure roller 6 substantially vertically. A width direction, that is, a short direction, of the rectification plate 22 extends vertically. A thickness direction of the rectification plate 22 extends horizontally. A longitudinal direction of the rectification plate 22 extends proximally and distally. Like the left rectification plate 20 shown in FIG. 11, the right rectification plate 22 is a rectangle elongated proximally and distally in the axial direction of the pressure roller 6.

The rectangular recess 57 (e.g., a rectangular notch) is disposed at each lateral end, that is, each of a front end and a rear end, of the upper leading edge, that is, the head wall 22*a*, of the right rectification plate 22 in an axial direction thereof. The rotary body 55 serving as an abutment is situated inside the recess 57. The shaft portion 56*a* of the rotary body 55 is mounted on front and rear lateral edges of the recess 57 in the longitudinal direction of the rectification plate 22. The outer circumferential surface 55*c* of the rotary body 55 projects radially beyond the recess 57 to contact the outer circumferential surface 6*a* of the pressure roller 6.

The spring 21 is anchored to a right part of each of lower, front and rear edges of the rectification plate 22. FIG. 15 illustrates the spring 21 anchored to the front edge of the rectification plate 22. For example, the side wall 22*f* projects rightward from each of the lower, front and rear edges of the rectification plate 22. The side wall 22*f* mounts the hinge shaft 53. The coil 21*c* of the spring 21 surrounds an outer circumference of the hinge shaft 53. The projection 21*a* at one end of the spring 21 is anchored to a right face of the rectification plate 22. The projection 21*b* at another end of the spring 21 is anchored to the cooling duct 49 depicted in FIG. 13 so that the spring 21 biases and pivots the rectification plate 22 counterclockwise leftward in FIG. 15.

A positional relation between each rotary body 55 mounted on the right rectification plate 22 and the outer circumferential surface 6*a* of the right part of the pressure roller 6 contacted by each rotary body 55 is equivalent to the positional relation between each rotary body 55 mounted on the left rectification plate 20 and the outer circumferential surface 6*a* of the left part of the pressure roller 6 contacted by each rotary body 55. Hence, the positional relation between each rotary body 55 mounted on the right rectification plate 22 and the pressure roller 6 is described below by referring to the reference numerals used in FIG. 12.

The pair of rotary bodies 55 mounted on the right rectification plate 22 is disposed outboard from the conveyance span L on the pressure roller 6 depicted in FIG. 12 where the sheets 13*a* and 13*b* are conveyed by the length L1 in the axial direction of the pressure roller 6. Accordingly, the rotary bodies 55 prevent abrasion of the pressure roller 6 due to contact with the sheets 13*a* and 13*b* and the rotary bodies 55. Additionally, even if the rotary bodies 55 damage the pressure roller 6, the pressure roller 6 does not degrade quality of the toner image fixed on the sheet 13*b*.

As shown in FIG. 15, each rotary body 55 is disposed inboard from the lateral edge face 6*b*, that is, the front lateral edge face and the rear lateral edge face, of the elastic roller body 6' of the pressure roller 6 by the length L2 depicted in FIG. 12 in the axial direction of the pressure roller 6. Each rotary body 55 disposed inboard from the lateral edge face 6*b* of the pressure roller 6 is not affected by variation in dimension at each lateral end of the pressure roller 6 in the axial direction thereof, retaining the given interval between the pressure roller 6 and the rectification plate 22.

As described above, by adjusting the shape, the material, and the position of the rotary bodies 55 rotatably mounted on the rectification plate 22 that moves in accordance with movement of the pressure roller 6 between the pressurization position where the pressure roller 6 is pressed against the fixing belt 7 and the depressurization position where pressure between the fixing belt 7 and the pressure roller 6 is released, abrasion of the pressure roller 6 and the rotary bodies 55 is suppressed. Additionally, degradation in accuracy, that is, variation, of the interval between the pressure roller 6 and the rectification plate 22 that may result from abrasion of the pressure roller 6 and the rotary bodies 55 is prevented, maintaining precision of the interval.

Further, adjustment in the position of the rotary bodies 55 with respect to the pressure roller 6 maintains precision of the interval between the pressure roller 6 and the rectification plate 22. The slit interval between the pressure roller 6 and the rectification plate 22 is retained evenly and constantly to retain a given slight amount of the cooling air 44 depicted in FIG. 13 leaking through the slit interval to an interior space of the fixing device 1 constantly, decreasing change in the temperature of the pressure roller 6 detected by the temperature sensor 43 on the left of the pressure roller 6.

Alternatively, instead of the rotary bodies 55, the abutments 46 mounted on the left rectification plate 20 depicted in FIG. 7, a rectangular block made of an abrasion resistant material that may not damage the pressure roller 6, such as PFA, or the like may be used as an abutment mounted on the right rectification plate 22.

Figure 16:
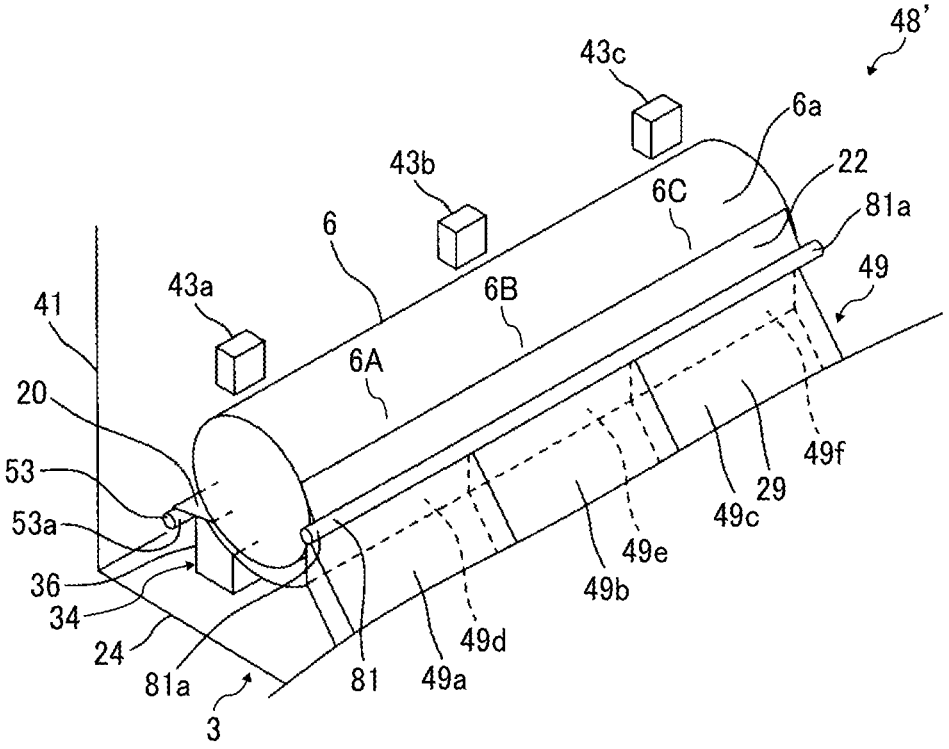
FIG. 16 is a perspective view of a cooler according to yet another example embodiment of the present disclosure.

With reference to FIG. 16, a description is provided of a construction of a cooler 48' as a variation of the cooler 48 depicted in FIG. 8.

FIG. 16 is a perspective view of the cooler 48'. As shown in FIG. 16, the cooler 48' includes the right rectification plate 22 in addition to the left rectification plate 20 of the cooler 48 depicted in FIG. 8. FIG. 16 illustrates the right rectification plate 22 located at a position higher than the position of the rectification plate 22 shown in FIGS. 13 and 14. It is to be noted that identical reference numerals are assigned to components shown in FIG. 16 that are identical to the components shown in FIG. 8 and a description of the identical components is omitted.

As shown in FIG. 16, the right rectification plate 22 of the cooler 48' is disposed opposite the front outlet 49*d*, the center outlet 49*e*, and the rear outlet 49*f* of the right cooling duct 49. The rectification plate 22 has a span equivalent to that of the cooling duct 49 in the axial direction of the pressure roller 6. The hinge shaft 81 is mounted on the upper edge of the right wall 29 of the cooling duct 49 and extended horizontally in a span slightly greater than that of the right wall 29 in the axial direction of the pressure roller 6. The right rectification plate 22 projects upward from the hinge shaft 81. For example, the hinge shaft 81 is rotatably supported by a bearing mounted on the upper edge of the right wall 29 of the cooling duct 49 such that the right rectification plate 22 and the cooling duct 49 are combined into a unit. The spring 21 depicted in FIG. 15 is anchored to each of front and rear ends 81*a* of the hinge shaft 81. The spring 21 biases and pivots the right rectification plate 22 counterclockwise leftward in FIG. 16. The front and rear rotary bodies 55 depicted in FIG. 15 contact the outer circumferential surface 6*a* of the right part of the pressure roller 6 constantly.

As shown in FIG. 16, the left rectification plate 20 is located lower than the right rectification plate 22. The spring 21 depicted in FIG. 11 anchored to each of front and rear ends 53*a* of the hinge shaft 53 biases and pivots the rectification plate 20 counterclockwise upward in FIG. 16 about the hinge shaft 53 mounted on an upper edge of the left wall 36 of the exhaust duct 34. For example, the hinge shaft 53 mounting the left rectification plate 20 is rotatably supported by a bearing mounted on the upper end of the exhaust duct 34 such that the left rectification plate 20 and the exhaust duct 34 are combined into a unit.

The right cooling duct 49 is constructed of three cooling ducts aligned in the axial direction of the pressure roller 6, that is, the front cooling duct 49*a*, the center cooling duct 49*b*, and the rear cooling duct 49*c* disposed opposite the front span 6A, the center span 6B, and the rear span 6C on the pressure roller 6 in the axial direction thereof, respectively. The front cooling duct 49*a*, the center cooling duct 49*b*, and the rear cooling duct 49*c* are in communication with the separate blowers, that is, the front cooling blower 51*a*, the center cooling blower 51*b*, and the rear cooling blower 51*c* depicted in FIG. 8, respectively. FIG. 16 illustrates the front temperature sensor 43*a*, the center temperature sensor 43*b*, and the rear temperature sensor 43*c* disposed opposite the front span 6A, the center span 6B, and the rear span 6C on the pressure roller 6, respectively. FIG. 16 further illustrates the right wall 41 and the bottom wall 24 of the lower cover 3. Like the cooling duct 26 depicted in FIG. 3, the cooling duct 49 includes the inlet 25 penetrating through the bottom wall 24. Alternatively, the front cooling blower 51*a*, the center cooling blower 51*b*, and the rear cooling blower 51*c* may be disposed below the bottom wall 24.

According to the example embodiments described above, the temperature sensor 43 is above the exhaust duct 34 and the cooling air 44 travels from the right cooling duct 49 to the left exhaust duct 34 as shown in FIG. 13. Alternatively, the cooling duct 49 and the exhaust duct 34 may change places each other. In this case, the cooling air 44 is directed reversely from left to right. For example, the cooling duct 49 is on the left and the exhaust duct 34 is on the right. The shape or the like of the exhaust duct 34 and the cooling duct 49 may be modified. The temperature sensor 43 is above the left cooling duct 49. The left rectification plate 20 depicted in FIG. 13 is disposed opposite the left cooling duct 49. The right rectification plate 22 depicted in FIG. 13 is disposed opposite the right exhaust duct 34. The positional relation between the pressure roller 6 and the fixing roller 5 is equivalent to that shown in FIG. 13.

In this case, in order to prevent production of an increased interval, that is, an increased opening, between the left cooling duct 49 and the pressure roller 6 as the pressure roller 6 is lifted and pressed against the fixing belt 7 as shown in FIG. 14, the rectification plate 20 disposed opposite the left cooling duct 49 covers the increased interval at a position below the interval. The rectification plate 20 disposed opposite the left cooling duct 49 reduces leakage of the cooling air 44 to a space inside the fixing device 1, preventing the leaked cooling air 44 from blowing against the temperature sensor 43 and resultant degradation in accuracy of the temperature sensor 43 to detect the temperature of the pressure roller 6.

While the pressure roller 6 is lifted and pressed against the fixing belt 7, a right interval, that is, an opening, between the right exhaust duct 34 and the pressure roller 6 is smaller than a left interval between the left cooling duct 49 and the pressure roller 6. If the cooling air 44 leaks through the right interval, the leaked cooling air 44 does not blow against the left temperature sensor 43 directly. However, the cooling air 44 leaked through the right interval may move to the right space 79 depicted in FIG. 13 inside the fixing device 1, decreasing the temperature of the space 79 and thereby adversely affecting the temperature sensor 43. Alternatively, the cooling air 44 leaked through the right interval may blow against the sheet 13*a* situated above the right interval and upstream from the pressure roller 6 in the sheet conveyance direction D13, causing jamming of the sheet 13*a*. The rectification plate 22 disposed opposite the right exhaust duct 34 attains advantages to those circumstances.

A description is provided of advantages of the fixing device 1 according to the example embodiments described above.

As shown in FIGS. 3, 8, and 16, the fixing device 1 includes the pressure roller 6 serving as an elastic rotator to exert pressure to a sheet 13*a* serving as a recording medium bearing a toner image to fix the toner image on the sheet 13*a*; the temperature sensor 43 serving as a temperature detector to detect the temperature of the pressure roller 6; and the cooler 45, 48, or 48' serving as a cooler to cool the pressure roller 6 with the cooling air 44. As shown in FIG. 4, the fixing device 1 further includes the mover 90 to move the pressure roller 6 to a first position, that is, the pressurization position or the fixing position, where the pressure roller 6 is pressed against the fixing belt 7 serving as a fixing rotator to form the fixing nip 10 therebetween and a second position, that is, the depressurization position or the isolation position, where pressure between the fixing belt 7 and the pressure roller 6 is released. When the pressure roller 6 is at the first position, the pressure roller 6 is disposed opposite the cooler with an increased first interval therebetween. Conversely, when the pressure roller 6 is at the second position, the pressure roller 6 is disposed opposite the cooler with a decreased second interval therebetween. The cooler is disposed opposite the rectification plates 20 and 22 that guide the cooling air 44 along the pressure roller 6 to the outside of the fixing device 1 regardless of whether the pressure roller 6 is at the pressurization position or the depressurization position.

Thus, the rectification plates 20 and 22 suppress temperature change inside the fixing device 1 due to the cooling air 44 and unstable motion of a sheet 13*b* serving as a recording medium conveyed through the fixing device 1.

The rectification plates 20 and 22 move in accordance with movement of the pressure roller 6. Accordingly, as the pressure roller 6 moves from the pressurization position to the depressurization position and from the depressurization position to the pressurization position, the rectification plates 20 and 22 move together with the pressure roller 6. Consequently, an increased interval, that is, an increased opening, is not produced between the cooler and the pressure roller 6.

The rectification plates 20 and 22 cover the interval that may appear along the pressure roller 6 between the cooler and the pressure roller 6 as the pressure roller 6 moves from the depressurization position to the pressurization position. For example, the rectification plates 20 and 22 cover the increased interval, that is, the increased opening, which may appear along the pressure roller 6 between the cooler and the pressure roller 6 as the pressure roller 6 returns to the pressurization position from the depressurization position. Thus, the rectification plates 20 and 22 suppress temperature change inside the fixing device 1 due to the cooling air 44 and unstable motion of the sheets 13*a* and 13*b* bearing the toner image that are conveyed through the fixing device 1.

Whether the pressure roller 6 is at the pressurization position or the depressurization position, a given interval is retained between each of the rectification plates 20 and 22 and the pressure roller 6 constantly. Accordingly, regardless of movement of the pressure roller 6 by the mover 90, a given decreased interval is maintained between each of the rectification plates 20 and 22 and the pressure roller 6 constantly, reducing temperature change inside the fixing device 1. For example, the abutment (e.g., the abutment 46 and the rotary body 55) is used to retain the given interval.

Each of the rectification plates 20 and 22 mounts the abutment that contacts the pressure roller 6. The abutment mounted on each of the rectification plates 20 and 22 contacts a part of the pressure roller 6, suppressing damage to the pressure roller 6. Since the abutment and a sheet (e.g., the sheets 13*a* and 13*b*) contact the pressure roller 6 at different spans thereof, respectively, the abutment does not interfere with motion of the sheet.

The abutment includes the rotary body 55. Accordingly, the rotary body 55 decreases friction between the pressure roller 6 rotating in the rotation direction D6 and the rotary body 55 contacting the pressure roller 6, suppressing damage to the pressure roller 6 further. The rotary body 55 is driven by the pressure roller 6 and is rotated in a direction opposite the rotation direction D6 of the pressure roller 6.

The rotary body 55 is made of PFA. Accordingly, the rotary body 55 decreases friction between the pressure roller 6 and the rotary body 55 contacting the pressure roller 6 further, suppressing abrasion of the pressure roller 6 and the rotary body 55.

As shown in FIG. 12, the abutment is disposed outboard from the conveyance span L on the pressure roller 6 in the axial direction thereof. Accordingly, the abutment does not contact the conveyance span L on the pressure roller 6 where the pressure roller 6 is susceptible to abrasion due to contact with the sheet, suppressing abrasion of the conveyance span L on the pressure roller 6. The sheet serves as a recording medium.

As shown in FIG. 12, the abutment contacts the pressure roller 6 in a contact span, that is, the lateral end 6*d*, outboard from the conveyance span L by the length L1 and inboard from the lateral edge face 6*b* of the pressure roller 6 by the length L2 in the axial direction thereof.

Accordingly, the abutment does not shift outboard beyond the lateral edge face 6*b* of the pressure roller 6 and therefore stably contacts the lateral end 6*d* of the pressure roller 6. Consequently, the abutment enhances precision in the interval between each of the rectification plates 20 and 22 and the pressure roller 6.

An amount of the cooling air 44 leaked through the interval between each of the rectification plates 20 and 22 and the pressure roller 6 into the space inside the fixing device 1 is retained at a given level, preventing degradation in detection accuracy of the temperature sensor 43 that detects the temperature of the pressure roller 6 and thus retaining a given detection accuracy. The rectification plates 20 and 22 decrease the leakage amount of the cooling air 44 substantially compared to an amount of the cooling air 44 that may leak to the space inside the fixing device 1 along the pressure roller 6 when the rectification plates 20 and 22 are not installed in the fixing device 1, preventing unstable motion of the sheet 13*b* conveyed through the fixing device 1.

As shown in FIGS. 3, 11, and 15, the spring 21 serving as a biasing member biases each of the rectification plates 20 and 22 and the abutment against the pressure roller 6. Accordingly, the abutment is pressed against the pressure roller 6 constantly, enhancing precision of the interval between the pressure roller 6 and each of the rectification plates 20 and 22.

As shown in FIGS. 3, 8, and 16, the cooler (e.g., the coolers 45, 48, and 48') includes an upstream cooling duct (e.g., the cooling ducts 26 and 49) and a downstream exhaust duct (e.g., the exhaust duct 34). At least one of the rectification plates 20 and 22 is disposed opposite at least one of the cooling duct and the exhaust duct. The single rectification plate 20 or 22 is disposed opposite each of the cooling duct and the exhaust duct. Accordingly, the rectification plates 20 and 22 block the cooling air 44, suppressing leakage of the cooling air 44 to the space inside the fixing device 1 effectively.

As shown in FIGS. 8 and 16, a plurality of outlets (e.g., the front outlet 49*d*, the center outlet 49*e*, and the rear outlet 49*f*) and a plurality of temperature sensors (e.g., the front temperature sensor 43*a*, the center temperature sensor 43*b*, and the rear temperature sensor 43*c*) are aligned in the axial direction of the pressure roller 6 so that the cooling air 44 selectively blown out of the plurality of outlets cools the pressure roller 6 based on the temperature of the pressure roller 6 detected by the plurality of temperature sensors. Accordingly, the cooling air 44 selectively blown out of the plurality of outlets cools at least one of the front span 6A, the center span 6B, and the rear span 6C on the pressure roller 6 that is selected. Consequently, the cooling air 44 cools a selected span on the pressure roller 6 spanning in the axial direction thereof as needed.

As shown in FIG. 1, the image forming apparatus 200 incorporates the fixing device 1. Accordingly, the fixing device 1 eliminates failures such as uneven fixing of a toner image on a recording medium (e.g., the sheets 13*a* and 13*b*), creasing of the recording medium, and staining of a surface of the recording medium with melted toner transferred from the overheated pressure roller 6, thus improving quality of the image forming apparatus 200.

According to the example embodiments described above, the pressure roller 6 serves as an elastic rotator, a pressure rotator, or a pressure member. Alternatively, a pressure belt or the like may be used as an elastic rotator, a pressure rotator, or a pressure member.

The present disclosure has been described above with reference to specific example embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative example embodiments may be combined with each other and/or substituted for each other within the scope of the present disclosure.

What is claimed is:

1. A fixing device comprising:

an elastic rotator;

a cooler disposed opposite the rotator to cool the rotator with cooling air;

a mover to contact and move the rotator to a first position where the rotator is disposed opposite the cooler with an increased first interval therebetween and a second position where the rotator is disposed opposite the cooler with a decreased second interval therebetween; and a rectification plate movably mounted on the cooler to contact the rotator constantly to guide the cooling air to the cooler.

2. The fixing device according to claim 1, wherein the rectification plate moves in accordance with movement of the rotator.

3. The fixing device according to claim 2, wherein the rectification plate covers the increased first interval between the rotator and the cooler when the rotator is at the first position.

4. The fixing device according to claim 1, further comprising an abutment mounted on the rectification plate to contact the rotator to retain a third interval between the rotator and the rectification plate.

5. The fixing device according to claim 4, wherein the abutment includes a rotary body rotatably mounted on the rectification plate.

6. The fixing device according to claim 5, wherein the rotary body is made of polytetrafluoroethylene.

7. The fixing device according to claim 5, further comprising a shaft mounted on the rectification plate and mounting the rotary body.

8. The fixing device according to claim 5, wherein the rotary body projects beyond the rectification plate radially.

9. The fixing device according to claim 4, wherein the abutment is disposed outboard from a conveyance span on the rotator in an axial direction thereof where a recording medium is conveyed.

10. The fixing device according to claim 9, wherein the abutment is disposed outboard from the conveyance span by a first length and inboard from a lateral edge face of the rotator by a second length in the axial direction of the rotator.

11. The fixing device according to claim 4, further comprising a biasing member anchored to the rectification plate to press the abutment mounted on the rectification plate against the rotator.

12. The fixing device according to claim 11, wherein the biasing member includes a torsion coil spring anchored to the cooler and the rectification plate.

13. The fixing device according to claim 12, further comprising a hinge shaft mounted on the rectification plate and inserted into the torsion coil spring, wherein the rectification plate pivots about the hinge shaft in accordance with movement of the rotator contacting the abutment on the rectification plate.

14. The fixing device according to claim 4, wherein the abutment includes a rectangular plate tilted relative to the rectification plate.

15. The fixing device according to claim 14, further comprising a rectangular recess disposed in the rectification plate and mounting the rectangular plate of the abutment.

16. The fixing device according to claim 15, wherein the abutment projects from the recess beyond the rectification plate.

17. The fixing device according to claim 1, wherein the cooler includes:

a cooling duct; and an exhaust duct disposed downstream from the cooling duct in a direction of traveling of the cooling air, and wherein at least one of the cooling duct and the exhaust duct mounts the rectification plate.

18. The fixing device according to claim 1, further comprising at least one temperature detector disposed opposite the rotator to detect a temperature of the rotator.

19. The fixing device according to claim 18, wherein the at least one temperature detector includes a plurality of temperature detectors aligned in an axial direction of the rotator, wherein the cooler includes a plurality of outlets aligned in the axial direction of the rotator and disposed opposite the plurality of temperature detectors, respectively, and wherein the cooling air is selectively blown out of at least one of the plurality of outlets based on the temperature of the rotator detected by the plurality of temperature detectors.

20. An image forming apparatus comprising:

an image forming device to form a toner image; and a fixing device, disposed downstream from the image forming device in a recording medium conveyance direction, to fix the toner image on a recording medium, the fixing device including:

an elastic rotator;

a cooler disposed opposite the rotator to cool the rotator with cooling air;

a mover to contact and move the rotator to a first position where the rotator is disposed opposite the cooler with an increased first interval therebetween and a second position where the rotator is disposed opposite the cooler with a decreased second interval therebetween; and a rectification plate movably mounted on the cooler to contact the rotator constantly to guide the cooling air to the cooler.

* * * * *